166-274
10/21/80 XR 4,228,853 SR

United States Patent [19]
Harvey et al.

[11] 4,228,853
[45] Oct. 21, 1980

[54] PETROLEUM PRODUCTION METHOD

[76] Inventors: A. Herbert Harvey; John P. Govier, both of Dept. of Mining, Petroleum and Geological Engineering, University of Missouri, Rolla, Mo. 65401

[21] Appl. No.: 917,730

[22] Filed: Jun. 21, 1978

[51] Int. Cl.[2] ..... E21B 43/22; E21B 43/24
[52] U.S. Cl. ..... 166/248; 166/245; 166/272; 166/273; 166/274; 166/65 R
[58] Field of Search ..... 166/248, 272, 275, 274, 166/65 R, 269, 268

[56] References Cited

U.S. PATENT DOCUMENTS

| | | | |
|---|---|---|---|
| 2,801,090 | 7/1957 | Hoyer et al. | 166/248 X |
| 3,507,330 | 4/1970 | Gill | 166/248 |
| 3,605,888 | 9/1971 | Crowson et al. | 166/248 |
| 3,848,671 | 11/1974 | Kern | 166/248 |
| 3,862,662 | 1/1975 | Kern | 166/248 |
| 3,946,809 | 3/1976 | Hagedorn | 166/248 |
| 3,948,319 | 4/1976 | Pritchett | 166/248 |
| 3,958,636 | 5/1976 | Perkins | 166/248 |

*Primary Examiner*—Stephen J. Novosad
*Attorney, Agent, or Firm*—Senniger, Powers, Leavitt and Roedel

[57] ABSTRACT

A method for electrical resistance heating of select portions of a natural underground reservoir, in a geologic formation, that contains both crude oil and water. Through selective resistance heating, oil viscosity is reduced in the select portion of the reservoir. Thus, portions which would not normally be contacted by injected fluids may be rendered susceptible to recovery by water flooding or other recovery process. Thermal expansion of heated oil also facilitates oil recovery. Resistance heating is accompanied by injection of low resistivity liquid that functions both as a conductor, through which current passes into the select portions, and as a medium for displacing oil to a production well. The low resistivity liquid also conveys convective heat, which contributes to viscosity reduction. Alternatively, the method of the invention can be used for altering the drainage pattern of a well.

31 Claims, 30 Drawing Figures

FIG. 4

SELECTIVE HEATING OF LAYERED RESERVOIR

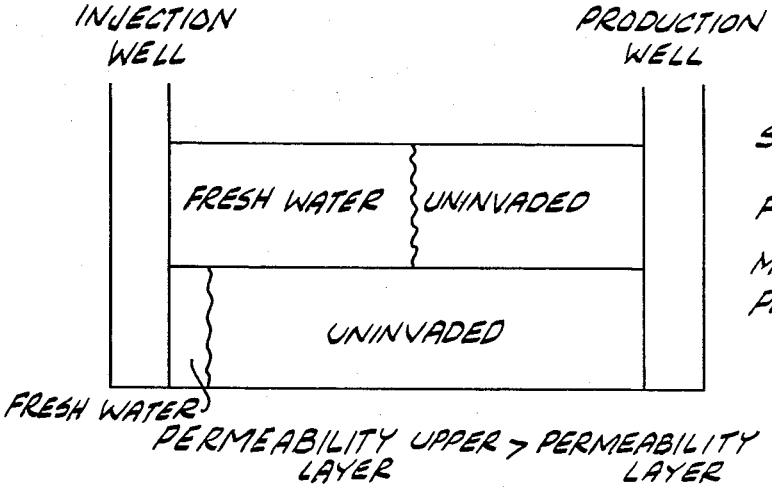

STEP 1:

FRESH WATER INJECTION

MOST WATER ENTERS HIGH PERMEABILITY LAYER

PERMEABILITY UPPER LAYER > PERMEABILITY LOWER LAYER

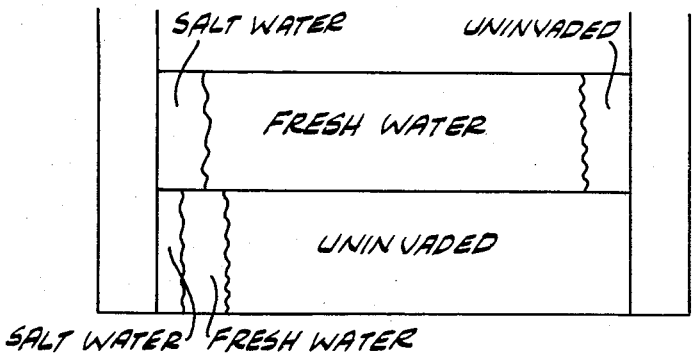

STEP 2:

ELECTRIC HEATING WITH SALT WATER INJECTION. THEN WATERFLOOD TO ECONOMIC LIMIT.

RESISTIVITY OF UPPER LAYER > RESISTIVITY OF LOWER LAYER

TEMPERATURE OF UPPER LAYER < TEMPERATURE OF LOWER LAYER

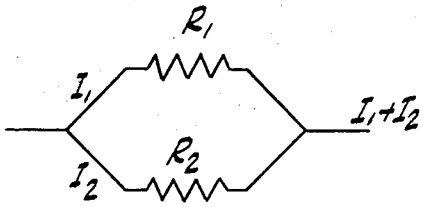

ANALOGY:

TWO RESISTORS IN PARALLEL $R_1 > R_2$ $I_1 < I_2$ $I_1^2 R_1 < I_2^2 R_2$

FIG. 5

SELECTIVE HEATING WITH MISCIBLE SLUG

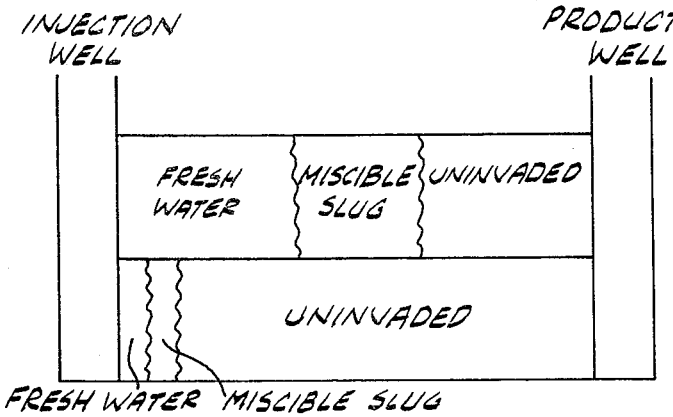

STEP 1:

INJECT MISCIBLE SLUG (HIGH RESISTIVITY); MAY FOLLOW WITH FRESH WATER.

MOST OF THE INJECTED FLUIDS WILL ENTER HIGH PERMEABILITY LAYER

PERMEABILITY UPPER LAYER > PERMEABILITY LOWER LAYER

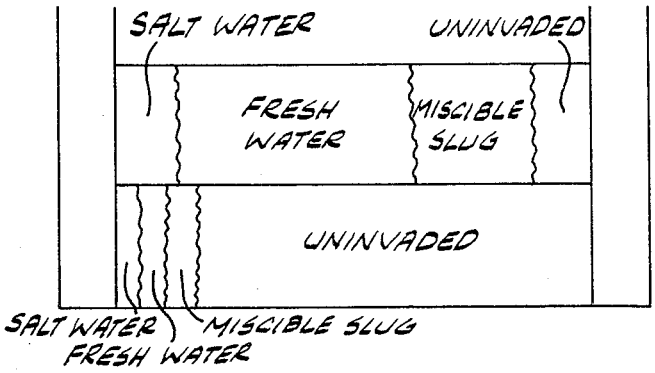

STEP 2:

ELECTRIC HEATING WITH SALT WATER INJECTION.

SLUG DISPLACES OIL MISCIBLY, THEREBY INCREASING OIL RECOVERY.

RESISTIVITY OF UPPER LAYER > RESISTIVITY OF LOWER LAYER

TEMPERATURE OF UPPER LAYER < TEMPERATURE OF LOWER LAYER

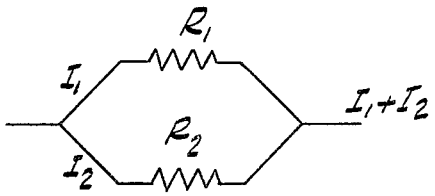

ANALOGY:

TWO RESISTORS IN PARALLEL $R_1 > R_2$ $I_1 < I_2$ $I_1^2 R_1 < I_2^2 R_2$

FIG. 6

SELECTIVE HEATING WITH VISCOUS SLUG

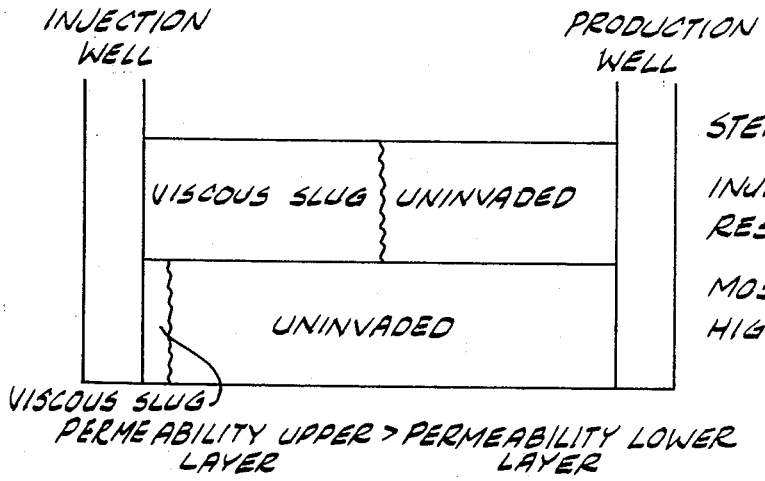

PERMEABILITY UPPER LAYER > PERMEABILITY LOWER LAYER

STEP 1:

INJECT VISCOUS SLUG (HIGH RESISTIVITY).

MOST OF SLUG WILL ENTER HIGH PERMEABILITY LAYER.

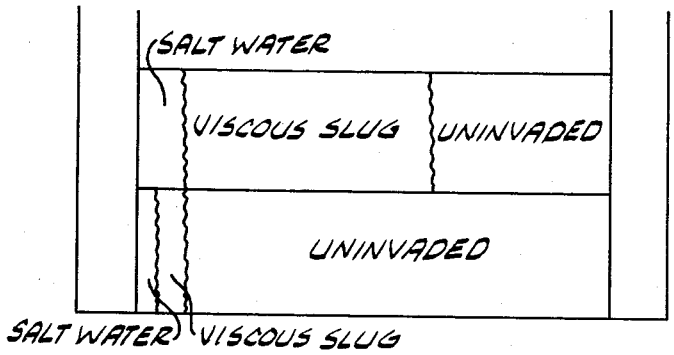

RESISTIVITY OF UPPER LAYER > RESISTIVITY OF LOWER LAYER

TEMPERATURE OF UPPER LAYER < TEMPERATURE OF LOWER LAYER

STEP 2:

ELECTRIC HEATING WITH SALT WATER INJECTION.

VISCOUS SLUG INCREASES OIL RECOVERY BECAUSE OF IMPROVED MOBILITY RATIO.

VISCOUS SLUG RESTRICTS FLOW MORE IN HIGH PERMEABILITY LAYER THAN IN LOW PERMEABILITY LAYER BECAUSE:

a. LESS SLUG ENTERS LOW PERMEABILITY LAYER b. HIGH TEMPERATURE OF LOW PERMEABILITY ZONE REDUCES SLUG VISCOSITY. MAY CHEMICALLY DECOMPOSE A POLYMER OR BREAK AN EMULSION.

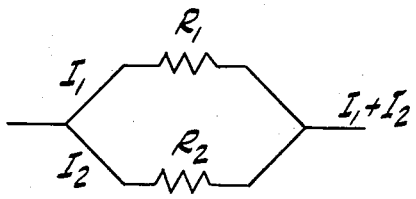

$R_1 > R_2$ $I_1 < I_2$ $I_1^2 R_1 < I_1^2 R_2$

ANALOGY:

TWO RESISTORS IN PARALLEL.

FIG. 7

ALTERATION OF WELL DRAINAGE PATTERN

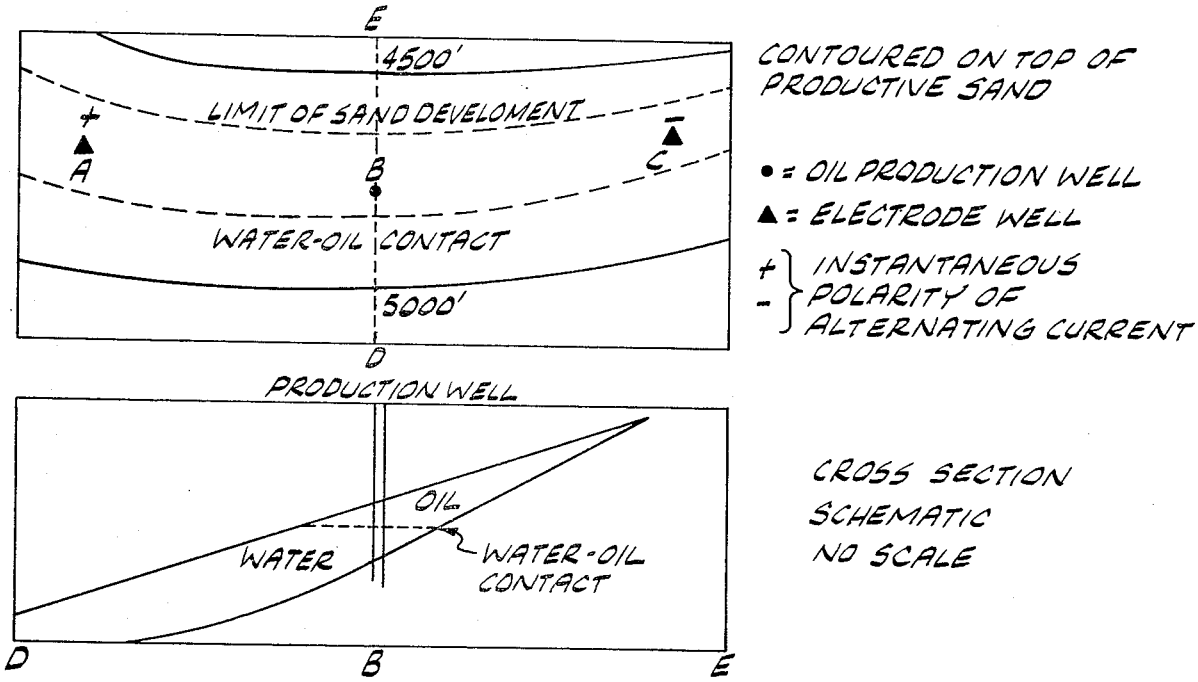

OBJECTIVE: ALTER DRAINAGE PATTERN OF PRODUCTION WELL B, SO DRAINAGE IN UP-DIP DIRECTION IS INCREASED.

PROCEDURE: INJECT FRESH WATER IN WELL B BELOW WATER-OIL CONTACT. THEN APPLY ELECTRIC POTENTIAL TO WELLS A AND C, AND START PRODUCING WELL B FROM OIL ZONE.

RESPONSE: INJECTED FRESH WATER DISPLACES MORE SALINE WATER FROM VICINITY OF WELL B. RESISTIVITY OF WATER ZONE NEAR WELL B IS INCREASED, SO MOST CURRENT FLOW BETWEEN WELLS A AND C IS THROUGH OIL ZONE, UP DIP FROM B. HEATING OF REGION UP DIP FROM B INCREASES WELL DRAINAGE IN THIS DIRECTION.

ANALOGY:

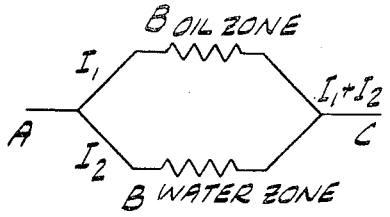

TWO RESISTORS IN PARALLEL. ONE REPRESENTS THE OIL ZONE; THE OTHER REPRESENTS THE WATER ZONE. BY INCREASING RESISTANCE OF WATER ZONE, CURRENT FLOW IN OIL ZONE IS INCREASED.

FIG. 8

SELECTED HEATING OF NON-LAYERED RESERVOIR

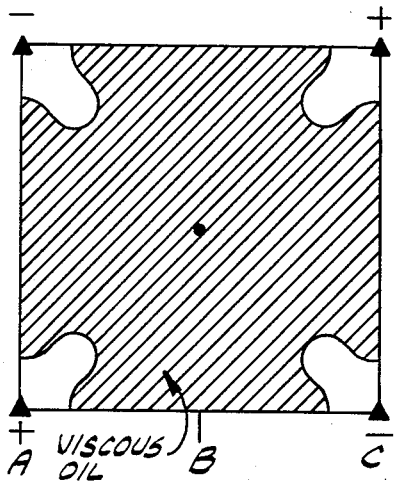

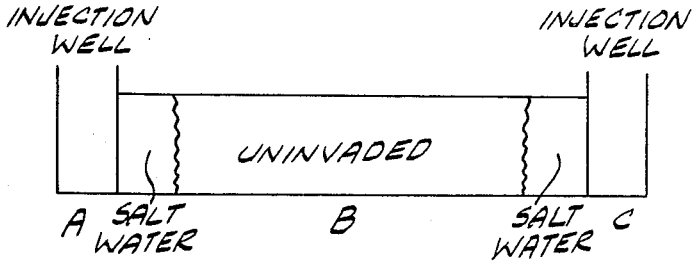

▲ = INJECTION WELL WITH ELECTRODE
• = PRODUCTION WELL

RESISTIVITY AT INJECTION WELLS LOWER THAN RESITIVITY OF UNINVADED RESERVOIR.

HEATING EFFECT FROM WELLS A AND C IS CONCENTRATED IN REGION B, WHICH IS CENTER OF AREA NOT NORMALLY SWEPT IN A PATTERN FLOOD.

AFTER HEATING, UNHEATED WATER IS INJECTED TO ECONOMIC LIMIT.

ANALOGY: THREE RESISTORS IN SERIES

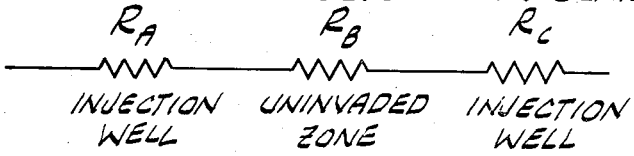

$R_B > R_A$, $R_B > R_C$ $I^2 R_B > I^2 R_A$ $I^2 R_B > I^2 R_C$

ELECTRIC POLARITY FOR 5-SPOT PATTERN

POLARITY INDICATED DIRECTS THE CURRENT FLOW THROUGH THE UNSWEPT AREA, THEREBY HEATING IT. OIL RECOVERY IS INCREASED BECAUSE OF VISCOSITY REDUCTION, THERMAL EXPANSION OF HEATED FLUIDS, AND EXTENSION OF SWEPT AREA. GAS EVOLUTION IN NORMALLY UNSWEPT AREA WOULD ALSO INCREASE OIL RECOVERY.

FIG. 10

ELECTRODES IN PRODUCTION WELLS
5-SPOT PATTERN

STEP I:

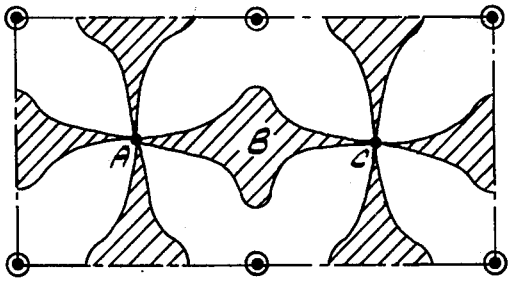

PATTERN FLOOD AT BREAKTHROUGH OF INJECTED SALT WATER. RESISTIVITY AT PRODUCTION WELLS A AND C IS LOW. RESISTIVITY IN UNSWEPT REGION B IS HIGH.

= AREA SWEPT WITH SALT WATER

• = PRODUCTION WELL

◉ = INJECTION WELL

STEP II:

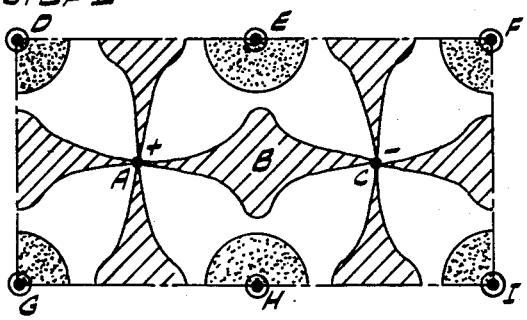

PATTERN FLOOD AFTER START OF SELECTIVE HEATING. FRESH WATER IS INJECTED IN INJECTION WELLS D, E, F, G, H AND I. ELECTRODES ARE INSTALLED IN PRODUCTION WELLS A AND C. USE ALTERNATE POLARITY FOR ADJACENT PRODUCTION WELLS THROUGHOUT THE FLOOD AREA.

= AREA SWEPT WITH FRESH WATER

+ / − = INSTANTANEOUS POLARITY OF AC CURRENT

ANALOGY OF STEP II

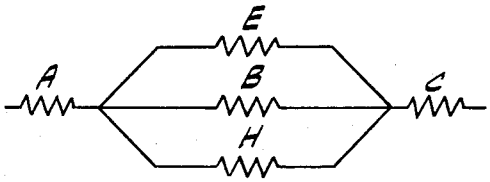

$R_A < R_B$
$R_C < R_B$
$R_E > R_B$
$R_H > R_B$

INJECTION OF FRESH WATER IN WELLS E AND H CAUSES RESISTIVITY TO BE HIGH NEAR THESE WELLS SO MOST OF CURRENT FLOWS THROUGH REGION B. SINCE RESISTIVITY NEAR PRODUCTION WELLS A AND C IS LOW, REGION B IS SELECTIVELY HEATED.

FIG. 12

EFFECT OF GAS EVOLUTION DURING HEATING

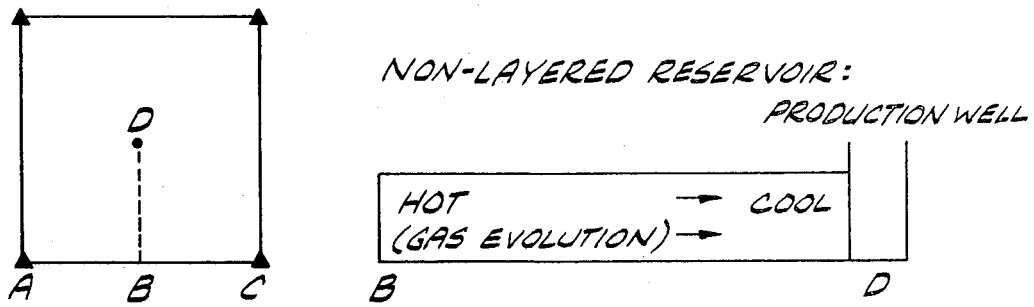

GAS EVOLVED BY HEATING REGION B (CENTER OF UNSWEPT AREA) DISPLACES OIL TOWARD LOW PRESSURE AREA (PRODUCTION WELL D).

BOTTOM ZONE HAS LOW PERMEABILITY AND IS SELECTIVELY HEATED.

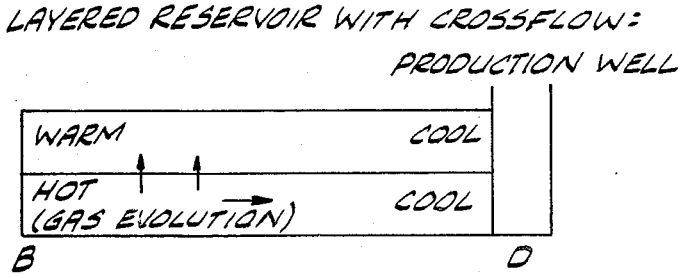

GAS IS EVOLVED FROM LOW PERMEABILITY LAYER THAT IS SELECTIVELY HEATED. OIL IS DISPLACED TOWARD LOW PRESSURE AREA (PRODUCTION WELL D). SOME OIL DISPLACED INTO HIGH PERMEABILITY LAYER BY CROSS-FLOW.

MEASURED AND CALCULATED ELECTRIC POTENTIAL DISTRIBUTION
SELECTIVE HEATING OF LABORATORY MODEL HEATING TIME 0.17 MINUTE

MEASURED AND CALCULATED POTENTIAL DISTRIBUTION
SELECTIVE HEATING OF LABORATORY MODEL
HEATING TIME 29.5 MINUTES

MEASURED AND CALCULATED TEMPERATURE DISTRIBUTION
SELECTIVE HEATING OF LABORATORY MODEL
HEATING TIME 29.5 MINUTES

MEASURED AND CALCULATED TEMPERATURE DISTRIBUTION
SELECTIVE HEATING OF LABORATORY MODEL
UNHEATED WATER INJECTED FOR 34.33 MINUTES

CALCULATED WATER SATURATION BEFORE HEATING
FIELD CASE I

CALCULATED SALT CONCENTRATION BEFORE HEATING
FIELD CASE I

ELELECTRIC CURRENT AND TEMPERATURE INCREASE
FIELD CASE I

CALCULATED TEMPERATURE DISTRIBUTION AFTER HEATING
FIELD CASE I

OIL RECOVERY BY SELECTIVE HEATING
FIELD CASE I

WATER INJECTION RATE AND PRESSURE DROP
FOR THE MORE PERMEABLE LAYER
FIELD CASE II

CALCULATED WATER SATURATION DISTRIBUTION BEFORE HEATING MORE PERMEABLE LAYER FIELD CASE II

WATER SATURATION DISTRIBUTION BEFORE HEATING LESS PERMEABLE LAYER FIELD CASE II

ELECTRIC CURRENT
FIELD CASE II

INCREASE IN AVERAGE RESERVOIR TEMPERATURE
FIELD CASE II

OIL RECOVERY BY SELECTIVE HEATING THE LESS PERMEABLE LAYER
FIELD CASE II

OIL RECOVERY BY SELECTIVE HEATING MORE PERMEABLE LAYER
FIELD CASE II

PETROLEUM PRODUCTION METHOD

BACKGROUND OF THE INVENTION

This invention relates to the field of petroleum production from oil bearing geological formations, and more particularly to various methods of selective electrical resistance heating for facilitating the recovery of oil from locations that are not normally susceptible to commercial recovery by fluids injected for secondary or tertiary recovery purposes.

The progressive depletion of domestic oil reserves has generated substantial development work directed to methods for secondary or tertiary recovery. A common secondary recovery method that has received substantial commercial use is flooding by means of a fluid, such as water or steam. In such flooding methods the fluid is typically injected into a formation at an injection well for the purpose of driving oil from a porous zone of the formation toward a production well, where it is recovered. Although substantial amounts of oil can be recovered by flooding, it is not possible to recover all of the oil contained in the formation. There are a number of limitations which prevent exhaustive recovery of the oil from a formation by flooding techniques.

Petroleum which is not subject to primary recovery is typically distributed along with connate water in porous rock or sand. Throughout this specification, the terms "oil" and "petroleum" refer to crude oil, including high molecular weight hydrocarbons that are sometimes referred to in the art as "tars". If the oil in a reservoir is of relatively high viscosity, an injected fluid tends to channel through the oil zone of a porous geologic formation rather than displacing oil toward a production well. In many cases it is impractical to achieve adequate flow without heating the oil to reduce the viscosity. Thus, water or fluid flooding is sometimes carried out with hot water or steam. In numerous instances, however, even the use of steam flooding is not practically effective for heating the oil content of the reservoir and effecting its movement through the formation to a recovery well. Thus, for example, if the reservoir is at too great a depth, steam heating may not be economical. In certain other cases steam heating may be ineffective for recovery from a portion of the reservoir because of very low permeability, inaccessibility, or pressure limitation.

Many formations contain layered reservoirs in which the permeability of the layers differs and injected fluids preferentially flow through the more permeable layers, largely bypassing the less permeable layers. Once the more permeable layers are depleted as a result of fluid injections, further recovery is generally uneconomical because either the rate of fluid penetration into the low permeability zone is too low, or fluid bypassing through the more permeable zones causes the production of an excessive ratio of injected fluid to oil at the production well. Schemes for avoiding this effect include plugging of the more permeable zone and selective well completion, but such schemes are expensive and frequently ineffective.

In order to promote the recovery of oil by flooding, proposals have been made to utilize electrical resistance heating. As described, for example, in Crowson et al U.S. Pat. No. 3,605,888, resistance heating is utilized to provide hot water or steam in the hydrocarbon zone in the well for use as a flooding medium and to reduce the viscosity of oil in the reservoir. However, the commercial application of electrical resistance heating has been inhibited by the relatively high cost thereof. Thus, it is generally not competitive simply as a means for generating steam, and direct steam injection is less expensive than electrical resistance heating for reducing oil viscosity. Thus, as a general energy source for facilitating secondary recovery, electrical resistance heating has been less attractive than older and more conventional techniques.

Despite their usefulness and cost advantages over resistance heating for general secondary recovery purposes, the hot water flooding and steam flooding techniques conventionally used in the art have, as noted above, not been effective to recover all the potentially available oil, particularly that in relatively inaccessible locations such as deep reservoirs, low permeability formations and the normally bypassed regions of a pattern flood.

The secondary recovery of low or moderate viscosity oil is frequently accomplished by the injection of unheated water. This technique is effective for recovering oil from portions of the reservoir that are swept by the injected water, but water flooding frequently bypasses oil in low permeability zones and in unswept portions of the flood pattern. Thus a technique is needed for recovering oil that is bypassed by a water flood or other recovery technique. More generally, a need has remained for improved methods which are capable of reducing oil flow resistance, and thereby increasing the recovery of oil from otherwise inaccessible regions.

SUMMARY OF THE INVENTION

Among the several objects of the present invention, therefore, may be noted the provision of improved secondary or tertiary methods for the recovery of petroleum from geological formations; the provision of such methods which achieve recovery from portions of a reservoir that are otherwise relatively inaccessible to injected fluids; the provision of such methods which are effective for recovery of oil from low permeability layers or formations; the provision of such methods which are effective for the recovery of oil from deep reservoirs; the provision of such methods which are effective for recovery from those regions of a formation which would be normally bypassed by injected fluid in a pattern flood; the provision of such methods which enhance oil recovery by altering the drainage pattern in a formation; and most particularly, the provision of such methods which achieve recovery of oil from relatively inaccessible locations by selective resistance heating of the area, zone or region from which recovery is sought.

In one of its essential embodiments, therefore, the present invention is directed to a method for facilitating recovery of oil from a crude oil reservoir by selective electrical resistance heating of a portion of the reservoir which would normally be substantially bypassed by fluid injected into the formation in which the reservoir is located. In accordance with the method, an electrical circuit is established for passing current through the formation along a directed path differing from the naturally predominant path of injected fluid flow. This circuit comprises a source of alternating current electrical power; a first subterranean electrode electrically connected to one terminal of the source and located in or in proximity to a first well in the formation; a second subterranean electrode electrically connected to the other terminal of the source and located in or in proximity to a second well in the formation; and a portion of an oil reservoir in the formation that contains oil and water and is located between the electrodes substantially separate from a naturally predominant path for flow of injected fluids from an injection well through the formation, but affords a current path of lesser electrical resistance between the electrodes than that along the naturally predominant path or any alternative path through the formation that is entirely outside the portion. A low resistivity liquid is injected through an injection well into a region of the formation that forms a part of the circuit in series with the first electrode and the portion. Alternating current is passed from the power source through the circuit so as to cause selective electrical resistance heating of the portion, whereby the resistance to flow of oil contained in the portion is reduced and oil is swept out of the portion by the low resistivity liquid.

In one of its principal embodiments, the present invention is directed to a method for recovering additional oil from a geologic formation that has been subjected to a prior injection of high resistivity fluid through an injection well for recovery of oil from a recovery well to which oil has been moved by reservoir pressure and the force of the high resistivity injected fluid. In this method, a series electrical circuit is established comprising a source of alternating current electric power; a first subterranean electrode electrically connected to one terminal of the source and located in the formation in or in proximity to a first well in the formation; a second subterranean electrode electrically connected to the other terminal of the source and located in the formation in or in proximity to a second well in the formation; and a portion of an oil reservoir, located between the electrodes in the formation, that contains oil and salt water and has been substantially bypassed by the injection of high resistivity fluid. A low resistivity liquid is injected through an injection well into a region of the formation that forms a part of the circuit in series with the first electrode and the portion. Alternating current is passed from the power source through the circuit so as to cause selective electrical resistance heating of the portion, whereby the resistance to the flow of oil contained in the portion is reduced and oil is swept out of the portion by the low resistivity liquid.

The invention is further directed to a method for recovering additional oil from a layered crude oil reservoir having layers of unequal permeabilities in a geologic formation that has been subjected to prior injection of a high resistivity fluid through an injection well for removal of oil from the reservoir to a recovery well where it is produced. In this method, a series electrical circuit is established comprising a source of alternating current electric power; a first subterranean electrode electrically connected to one terminal of the source and located in the formation in or in proximity to a first well in the formation; a second subterranean electrode electrically connected to the other terminal of the source and located in the formation in or in proximity to a second well therein; and a relatively low permeability layer of the reservoir, located between the electrodes in the formation, that contains oil and salt water and has been substantially bypassed by the injection of said high resistivity fluid. A low resistivity liquid is injected through an injection well into a region of the formation that forms a part of the circuit in series with the first electrode and the portion. Alternating current is passed from the power source through the circuit so as to cause selective electrical resistance heating of the low permeability layer, whereby the resistance to the flow of oil contained in that layer is reduced and oil is swept out of that layer by the low resistivity liquid.

In a further embodiment, the invention is directed to a pattern flooding method for recovering oil from a crude oil reservoir in a geologic formation wherein oil is recovered from a portion of a reservoir that is substantially separate from the naturally predominant path for fluid flow between any injection well and any recovery well in the pattern so that said portion normally is substantially bypassed by injected fluid. In this method, a series electrical circuit is established comprising a source of alternating current electric power; a first subterranean electrode electrically connected to one terminal of the source and located in the formation in or in proximity to a first well in the formation; a second subterranean electrode electrically connected to the other terminal of the source and located in the formation in or in proximity to a second well in the formation; and a portion of the reservoir that contains oil and water and is in a region substantially separate from the naturally predominant path for flow of injected fluid from any injection well to any recovery well in the pattern. A low resistivity liquid having a resistivity less than that of the connate water in the formation is injected through an injection well into a region of the formation that forms a part of the circuit in series with the first electrode and the portion. Alternating current power is passed from the power source through the circuit so as to cause selective electrical resistance heating of the portion, whereby the resistance to flow of the oil contained in the portion is reduced and oil is swept out of the portion by the low resistivity liquid.

The invention is further directed to another pattern flooding method for recovering oil from a crude oil reservoir in a geologic formation, wherein oil is recovered from a portion of the reservoir substantially separate from the naturally predominant path for flow of injected fluid from any injection well to any recovery well and thus normally bypassed by injected fluid. In this method, a pattern is provided comprising a plurality of injection wells disposed about a recovery well. An electric circuit is established between each injection well and each other injection well adjacent thereto in the pattern. Each circuit comprises a source of alternating current electric power; a first subterranean electrode electrically connected to one terminal of the source and located in the formation in or in proximity to a first injection well; a second subterranean electrode electrically connected to the other terminal of the source and located in the formation in or in proximity to an injection well adjacent to the first injection well, whereby the electrical polarity of the electrode in proximity to each injection well in the pattern is opposite to that of the electrode at each said adjacent injection well on either side thereof; and a portion of the oil reservoir, located between the electrodes in the formation, that contains oil and water and is substantially separate from the naturally predominant path for flow of injected fluid between either of said injection wells and a recovery well so that said portion is normally bypassed by injected liquid. A low resistivity liquid is injected through the injection wells into regions of the formation that form the parts of the circuit in series with the first and second electrodes, respectively, and said portion.

Alternating current is passed from said power source through each circuit so as to cause selective electrical resistance heating of each said portion, whereby the resistance to the flow of oil contained in each portion is reduced and oil is swept out of that portion by the low resistivity liquid.

The invention is further directed to a method for selectively heating a relatively oil-rich portion of a crude oil reservoir located adjacent a relatively oil-lean portion of said reservoir in a geologic formation so as to facilitate the recovery of oil from the reservoir. In this method a high resistivity fluid is injected into a relatively oil-lean portion of the reservoir adjacent the rich portion so that the electrical resistivity of the lean portion is increased. A series electrical circuit is established comprising a source of alternating current electric power; a first subterranean electrode electrically connected to one terminal of the source and located in the formation in or in proximity to a first well in the formation; a second subterranean electrode electrically connected to the other terminal of the source and located in the formation in or in proximity to a second well in the formation; and said rich portion which is located between the electrodes. A low resistivity liquid is passed through an injection well into a region of the formation that forms a part of the circuit in series with the first electrode and the rich portion. Alternating current is passed from the power source through the circuit so as to cause selective electrical resistance heating of the rich portion, whereby the resistance to flow of oil in that portion is reduced and oil is removed from that portion and recovered through a recovery well.

The invention is also directed to a method for selectively heating a relatively oil-rich portion of a crude oil reservoir in a geologic formation so as to alter the drainage pattern relative to a well in the formation and to facilitate recovery of oil therefrom. In this method a high resistivity fluid is injected into a relatively oil-lean portion of the reservoir adjacent the rich portion for the purpose of increasing the electrical resistivity of the lean portion. A series electrical circuit is established comprising a source of alternating current electric power; a first subterranean electrode electrically connected to one terminal of the source and located in the formation in or in proximity to a first well in the formation; a second subterranean electrode electrically connected to the other terminal of the source and located in the formation in or in proximity to a second well in the formation; and the rich portion located between the electrodes. A low resistivity liquid is injected through an injection well in a region of the formation that forms a part of the circuit in series with the first electrode and the rich portion. Alternating current power is passed from the power source through the circuit so as to cause selective electrical resistance heating of the rich portion, whereby the resistance to flow of the oil contained in the rich portion is reduced so that drainage of oil from the rich portion to a recovery well is provided.

BRIEF DESCRIPTION OF THE DRAWINGS

FIG. 4 is a schematic drawing showing an embodiment of the invention wherein selective electrical resistance heating is utilized to facilitate recovery from the less permeable layer of a layered reservoir;

FIG. 5 is a schematic drawing showing an embodiment of the invention similar to that of FIG. 4, wherein application of electrical current is preceded by injection of a slug miscible with oil;

FIG. 6 is a schematic drawing showing an embodiment similar to that of FIG. 4, wherein the application of current is preceded by injection of a viscous slug which facilitates recovery from a less permeable layer by reducing the rate of flow through the more permeable layer;

FIG. 7 is a schematic drawing showing an embodiment of the invention wherein electrical resistance heating is utilized to alter a well drainage pattern and facilitate recovery from a dipping reservoir;

FIGS. 8 and 9 are schematic drawings showing an embodiment of the invention wherein selective electrical resistance heating is utilized to facilitate recovery of oil from the normally unswept portions of a 5-spot pattern flood, with current applied through injection well electrodes of alternating polarity;

FIG. 10 is a schematic drawing showing an embodiment of the invention wherein electrical resistance heating is utilized to facilitate recovery of oil from the normally unswept portions of a 5-spot pattern flood, with current introduced through electrodes at the production wells;

FIG. 12 illustrates the effect of gas evolution in assisting recovery from a selectively heated portion of a reservoir;

DESCRIPTION OF THE PREFERRED EMBODIMENT

Figure 1:
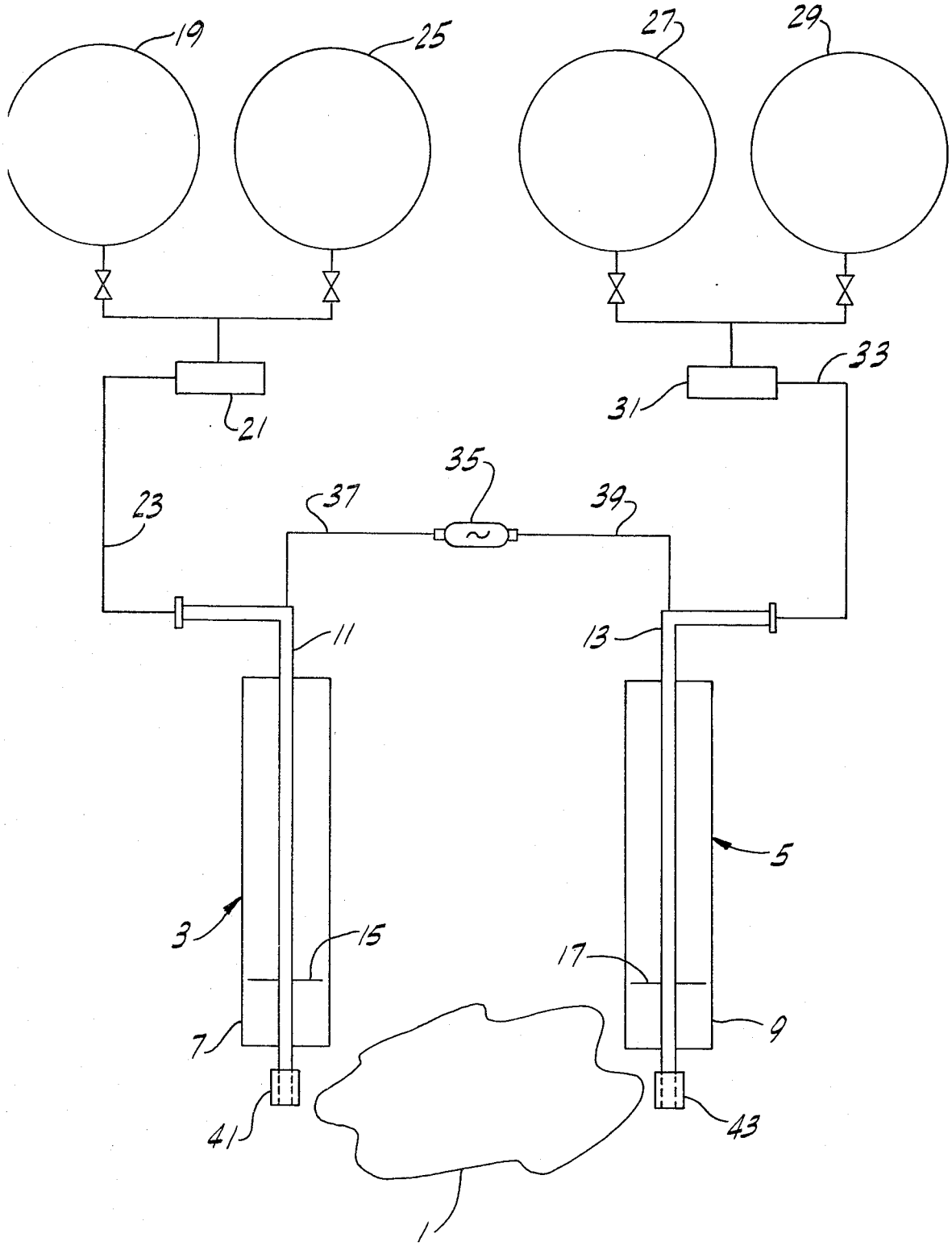
FIG. 1 is a schematic view of the physical arrangement for an electrical circuit and fluid injection system which may be utilized in the various embodiments of the invention.

In accordance with the present invention, a novel method of selective electrical resistance heating has been discovered, which facilitates the recovery of oil from a formation by water flooding or other techniques. Although petroleum itself is nonconductive, all natural underground oil reservoirs contain connate water which is capable of conducting sufficient current to allow electrical resistance heating of the reservoir, including its petroleum content.

The method of the invention is especially advantageous for promoting recovery through selective electrical resistance heating of those portions of the reservoir which would be relatively inaccessible to injected fluids or otherwise not susceptible to recovery by conventional water flooding methods. In implementing the method of the invention, electric current flow is effectively concentrated in or directed through the portion of the oil reservoir which is sought to be heated. By concentrating current in the particular portion of the reservoir whose susceptibility to recovery is substantially improved by heating, the cost disadvantages of prior art methods for general electrical resistance heating of a formation are avoided. At the same time, the various embodiments of the invention facilitate recovery from otherwise inaccessible portions of the reservoir, which would not be significantly affected at all by the methods in which electrical resistance heating is used for in situ generation of steam or hot water for a heated fluid flooding operation.

Concentration of current in the specific portion to be heated is achieved by proper location of the electrodes and by various techniques for rendering a path through the portion which is to be heated significantly more conductive than the surrounding regions of the formation. Although there are a number of different specific procedures for achieving this result, an essential element for each of them is the establishment of an electrical circuit including a pair of subterranean electrodes having the portion to be heated disposed between them. The method is further characterized by the injection of a relatively low resistivity liquid, such as high salinity water, into a region of the formation that forms a part of the circuit in series with an electrode and the portion to be heated. Depending on the configuration of the formation and the reason for normal inaccessibility of the portion to be heated, injection of a low resistivity liquid in series with that portion may be preceded by injection of a high resistivity fluid into an adjacent region in order to minimize current flow through the latter region.

In each embodiment of the invention, low resistivity liquid is injected not only for the purpose of facilitating preferential flow of current through the portion to be heated, but also for the purpose of moving oil out of the heated portion as heating causes the viscosity of the oil in that portion to decrease. It is generally preferable, and in certain instances essential, that the liquid injected for establishing the circuit have a resistivity less than that of the connate water. Low resistivity liquid is needed to prevent boiling near the electrode and to reduce heating near the electrode well, where heating is less effective. Regardless of the nature of the formation from which additional recovery is sought, the injection of low resistivity liquid both before and during at least a portion of the heating cycle helps to concentrate current flow in the desired portion.

Alternating current is passed between two electrodes through the select portion of the reservoir. Normally one of these electrodes is located in or in proximity to an injection well. The other electrode is located in or in proximity to a second well which, in some cases, is a recovery well and in others is another injection well.

Heating is preferably carried out until the temperature of the designated portion has been raised by approximately 125°–150° F. Depending on the permeability of the formation and the composition and viscosity characteristics of the oil content thereof, recovery may be substantially facilitated even when the portion in question has been heated to a temperature considerably less than 125° F. above ambient formation temperature. In other cases, heating to a temperature greater than 150° F. above ambient may be optimal. As a general proposition for many formations, however, heating to a temperature in the ambient plus 150° F. range is most satisfactory.

In order to achieve the necessary temperature increase in a reasonable period of time, it is desirable to introduce current at a high wattage. Optimum voltage may be selected on the basis of other parameters of the system, most importantly factors such as resistivity of the fluid-saturated reservoir rock, salinity of injected water, well spacing, and rate of water injection. Conveniently, the power source may operate at a voltage of 110 to 5000 v, usually 1000 to 2500 v, but less than the voltage which would cause boiling of the injected water. Amperage may be on the order of 30 to 120 amps per foot of vertical thickness of the hydrocarbon zone.

As noted, attainment of the desired current flow is promoted by injection of low resistivity liquid. In the context of this invention, the low resistivity liquid utilized preferably has a resistivity of no greater than about one-half the resistivity of connate water at the same temperature.

Where high resistivity fluid is injected into certain regions of a formation to render them nonconductive relative to the select current path, resistivity of the fluid so injected should be at least about 2.5 ohm meters, as provided, for example, by substantially fresh water at 150° F. having a salinity no greater than 1000 ppm.

Referring now to FIG. 1 of the drawings, there is shown at 1 a portion of a crude oil reservoir which is to be subjected to electrical heating. In addition to oil, portion 1 contains connate water, and in certain embodiments, it may contain injected water which has flushed out connate water but has not effectively displaced the petroleum content of the portion. Portion 1 is disposed in a geologic formation between injection well 3 and a second well 5, which is also shown as an injection well but which, in certain embodiments of the invention, could be a recovery well. Wells 3 and 5 are provided with casings 7 and 9, respectively. Injection pipes 11 and 13, constituted of a conductive material such as aluminum and externally insulated, extend through casings 7 and 9 and are maintained out of contact with the casings by nonconductive centralizers 15 and 17. Low resistivity liquid held in a storage tank 19 may be delivered to injection pipe 11 by a pump 21 through a delivery pipe 23, while high resistivity liquid may be delivered through the same pump and delivery pipe from a storage tank 25 to injection pipe 11. Similarly, low resistivity liquid from a storage tank 27, or high resistivity liquid from a storage tank 29, may be delivered by a pump 31 through a delivery line 33 to injection pipe 13.

The terminals of an alternating current power source 35 are connected to injection pipes 11 and 13 through electrical cables 37 and 39, respectively. A hollow tubular carbon electrode 41 is disposed at the lower terminus of injection pipe 11, while a similar electrode 43 is disposed at the lower terminus of injection pipe 13. Well casings 7 and 9 are isolated from the electrodes and from all other elements of the circuit so as to minimize electrical leakage to beds overlying portion 1.

Figure 2:
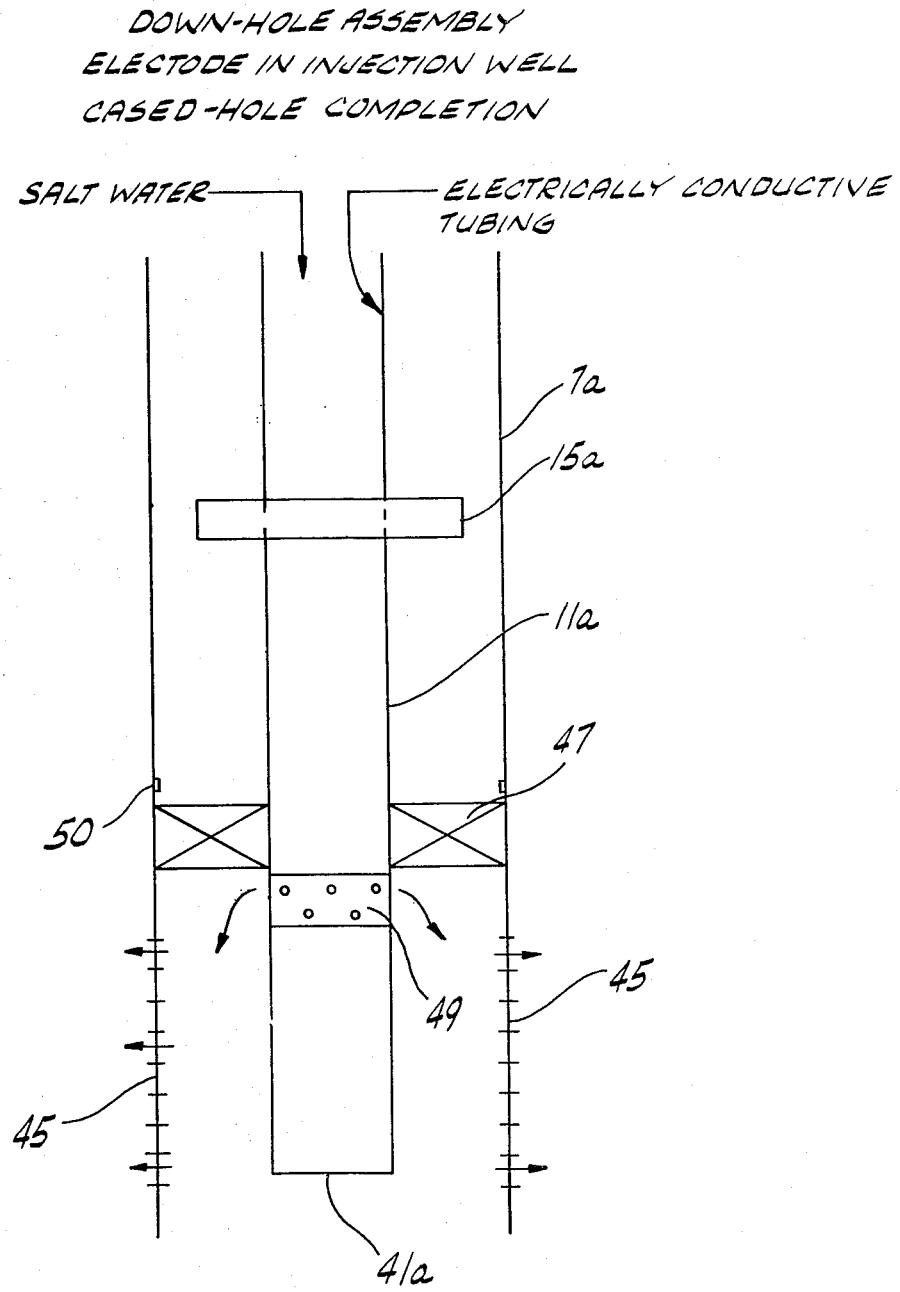
FIG. 2 is a schematic drawing showing an alternative construction for an injection well in which an electrode is placed pursuant to the overall scheme of FIG. 1.

In the arrangements schematically illustrated in FIG. 1, the carbon electrode extends below the bottom of the casing into an open hole in the oil zone. In an alternative arrangement illustrated in FIG. 2, the hole is completely cased and fluids communicate between injection pipe 11*a* and the formation through perforations 45 in the casing. In this construction electrode 41*a* is solid rather than hollow. A packer 47 is disposed just above the lower terminus of pipe 11*a*, and a perforated tubing nipple 49 is provided at that terminus. An electrically insulating casing nipple 50 is installed above the packer 47.

Since externally insulated injection pipes 11, 11*a* and 13 are adapted to conduct both injected fluid and electricity, they must afford a flow cross sectional area adequate to handle the injected liquid without excessive pressure drop; and the combination of flow cross section and wall cross section must be adequate to permit the desired current flow without excessive voltage drop. The exemplary system illustrated is designed for an injection rate of 150,000–200,000 gallons per day, and an alternating electric current of 5,000–20,000 amps at 500–4,000 v. For a typical installation, this service can be met by 2½–3 in. nominal diameter aluminum pipe having a wall thickness of approximately ½ in. To conduct 5,000–20,000 amp current into the formation, the carbon electrodes should have a diameter of approximately 6 to 10 inches.

Figure 3:
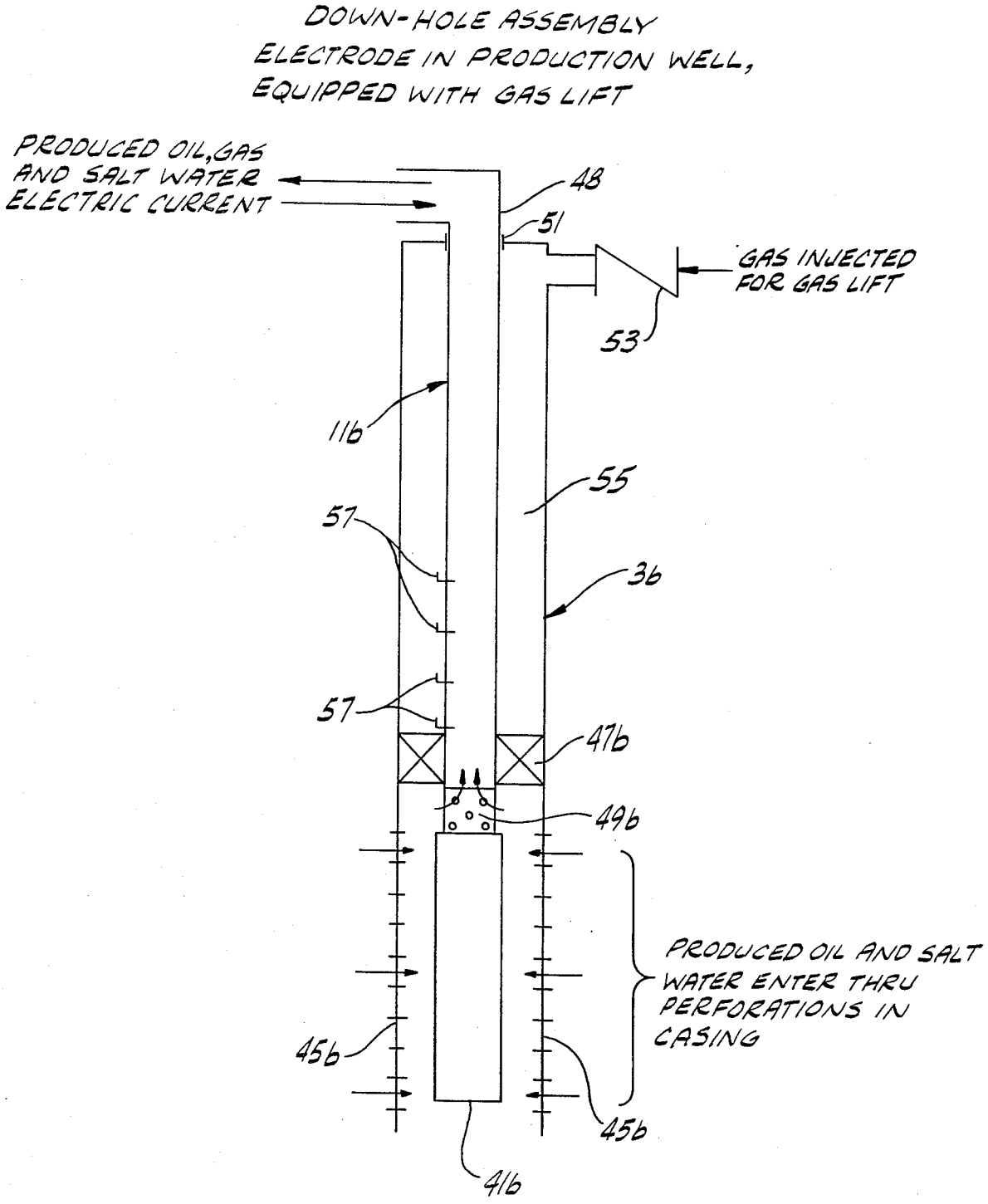
FIG. 3 is a schematic drawing showing a down hole construction in which a circuit electrode is provided at a production well.

FIG. 3 illustrates an arrangement wherein an electrode is disposed in a production well. The well construction is comparable to that of FIG. 2 in providing a casing 3*b* extending into the productive zone and having perforations 45*b*, through which fluids may communicate between recovery pipe 48 and the formation. A packer 47*b* is disposed just above the lower terminus of pipe 48, a perforated tubing nipple 49*b* is provided at that terminus, and a carbon electrode 41*b* depends therefrom. Injection pipe 48 is insulated from casing 3*b* by an insulating collar 51. An insulating casing joint (not shown) is installed at the level of the packer. The well is also adapted to assist the production of oil and salt water by means of a gas lift. Thus, a well head (not shown) at the top of casing 3*b* is provided with check valve 53 through which gas may be injected into the annular region 55 between casing 3*b* and pipe 48 above packer 47*b*. Gas passes from region 55 into the interior of pipe 48 through gas lift valves 57. The sizing and materials of construction for pipe 48 and electrode 41*b* are essentially the same as described above for an injection well, except that a somewhat greater wall thickness may be required for pipe 48 since the fluids contained in this pipe will not be very effective as an electric conductor.

An important feature that preferably characterizes many of the embodiments of the invention is the establishment of a preferential or directed current path which departs substantially from the naturally predominant path for injected fluid flow, i.e., the path along which injected fluids would normally flow as a result of the nature of the formation, characteristics of the reservoir, or location of wells. In these embodiments, the portion to be heated is separate from such a naturally predominant path but, by virtue of its location between the electrodes and/or measures to increase resistivity along other paths, affords a current path of lesser resistance between the electrodes than the naturally predominant path or any alternative path through the formation that is entirely outside the select portion. By creating a primary current path through a portion normally bypassed by injected fluids, oil viscosity reduction is achieved in the select portion through resistance heating, thereby inducing penetration of that portion by injected fluid. As a consequence, the injected fluid is able to move oil out of the select portion and displace oil in the direction of a recovery well. Thermal expansion of heated oil also facilitates recovery. In certain embodiments the ultimate path to the recovery well departs almost entirely from the natural path of injected fluid flow, while in other embodiments the reduction in viscosity caused by electrical resistance heating permits the injected fluid to drive the oil out of the portion which originally contains it, and into a natural path for fluid flow, through which it proceeds in a normal course to a recovery well for production.

In one particularly advantageous embodiment of the invention, selective electrical resistance heating is used to promote recovery of oil from a crude oil reservoir contained in a layered rock formation in which the rock layers have unequal permeabilities. This embodiment is illustrated schematically for a two-layered reservoir in FIG. 4 of the drawings. Where conventional water flooding is used in a layered reservoir with nonuniform permeability, the injected water flows preferentially through the high permeability layers and does not displace much of the oil contained in the low permeability layers during the economic life of the water flood. This result is not significantly altered by the use of conventional steam or hot water flooding, since such hot fluids pass readily through the high permeability layers, thereby bypassing the low permeability layers so that the latter are not effectively heated. These disadvantages are overcome, however, by the selective electrical resistance heating technique illustrated in FIG. 4.

FIG. 4 shows a formation containing a layered reservoir, each layer of which contains both oil and salt water. Recovery of oil from this layered reservoir is commenced by the injection of fresh water or another high resistivity fluid, which preferentially invades the high permeability layer and displaces oil therefrom from recovery at the production well. Injection of the high resistivity fluid serves the dual purpose of both recovering oil from the high permeability layer and displacing the salt water therefrom so that resistivity of the high permeability layer is increased. Elimination of such conductive material obviates the availability of the high permeability layer as a major alternative current path during the subsequent phase of electrical resistance heating.

To provide for resistance heating, an electrical circuit is established utilizing an arrangement of the type illustrated in FIG. 1, except that the second electrode may be located in or in proximity to either a production well or a second injection well. An electrical circuit is therefore established, including the alternating current power source, one electrode in an injection well, another electrode in a second well, and the low permeability layer of the reservoir disposed between the electrodes.

In the second step of the recovery operation, a low resistivity liquid, for example salt water, is injected through the injection well into the formation in a region that forms a part of the electrical circuit in series with the injection well electrode and the low permeability layer. Low resistivity fluid injection is continued as alternating current is applied to the circuit by the alternating current power source. The current thereby generated passes selectively through the injected low resistivity liquid and the salt water in the low permeability layer. This is illustrated by the conventional analogy for the circuit as shown at the bottom of FIG. 4, wherein the low permeability layer corresponds to low resistivity resistor $R_2$, through which current passes preferentially to high resistivity resistor $R_1$ (the high permeability layer). Preferably, the resistivity of the liquid injected during this step is lower than that of the connate water in the reservoir so that the principal voltage drop and greatest heat generation is concentrated in the portion of the reservoir where heating is desired, rather than in the immediate vicinity of the electrode well, thus achieving efficient utilization to electrical energy. Boiling of injected liquid is also avoided. Inevitably, of course, some power is consumed in the passage of current through the injected liquid and the sensible heat content of the injected liquid thereby increased. However, provided that the maximum feasible energy consumption is concentrated in the portion of the low permeability oil zone uninvaded by high resistivity fluid, heating of the injected liquid to temperatures below its boiling point are not disadvantageous. For as the viscosity of the oil in the low permeability layer falls and movement of oil commences, the consequent penetration of the low permeability layer by injected fluid affords additional convective heating of the oil in that layer. Some of the heat generated in the injected liquid is necessarily lost because that liquid distributes itself between both of the layers of the reservoir. However, the selective heating of the low permeability layer will increase the proportion of the injected fluid which enters this layer, so that oil recovery from the low permeability layer is increased.

Although fresh water is advantageously used for initial invasion of the high permeability layer for removal of oil and salt water therefrom, it will be understood that other high resistivity fluids can be used for this purpose. Thus, for example, air or another gas or nonconductive liquid could be used. Fresh water is usually the most advantageous, because of cost.

Depending on the nature of the formation, the injection of low resistivity liquid and application of electric current may be conducted on a variety of schedules. In order to maximize the total current and minimize the power loss between the electrodes and the portion to be selectively heated, it is preferable that low resistivity liquid injection begin simultaneously with or somewhat prior to the application of electric current. In fact, injection of low resistivity liquid prior to application of current conserves energy by minimizing the amount of power consumed in heating the region immediately surrounding the electrode at the well, and correspondingly maximizing the amount of power utilized for heating the select portion. However, injection of a low resistivity liquid should not be carried out to the extent that it substantially invades the high permeability layer prior to the application of current. As noted, it is preferable to continuously inject the low resistivity liquid during electrical resistance heating for the several purposes of preventing boiling near the electrode, moving the heated oil through the low permeability layer to the production well, and convective heating of the oil remaining in that layer. To provide the desired temperature control, resistance heating may be carried out continuously or intermittently. Commonly, the desired temperature is reached before recovery is complete and, in such instances, application of current may be terminated and injection of liquid continued in order to complete the recovery process.

FIG. 5 shows an alternative embodiment of the invention for recovery of oil from the low permeability layer of a layered crude oil reservoir where connate water is salty. In this embodiment, the high resistivity fluid, which is injected prior to the application of electric potential, is designed to achieve miscibility with reservoir oil, so that recovery of this oil is facilitated by solvent action. The electrical analogy for this embodiment, which is illustrated at the bottom of FIG. 5, is identical to that of the embodiment of FIG. 4. Overall, the procedure is substantially similar to that of FIG. 4, except that a solvent, such as an alcohol, miscible microemulsion, liquid hydrocarbon, liquefied gas, liquefied hydrocarbon gas, high pressure gas, "rich gas", liquefied carbon dioxide, liquefied hydrogen sulfide, or another organic compound is initially injected through the injection well as a slug miscible with the oil. This slug preferentially invades the high permeability layer, facilitating recovery of oil therefrom. Typically, the miscible slug is followed by injection of fresh water for substantial elimination of salt water from the high permeability layer. As noted in the drawing, relatively small fractions of both the miscible slug and the fresh water may invade the low permeability layer during initial injection. The presence of a relatively narrow layer of oil-miscible fluid at the head of the injected liquid front does not appreciably reduce the conductance of a path through the connate water in the low permeability layer, but it affords the advantage of facilitating displacement of oil from that layer during the resistance heating and low resistivity fluid injection step.

FIG. 6 illustrates a further alternative embodiment of the invention for recovery of oil from the low permeability layer of a layered crude oil reservoir where connate water is salty. In this embodiment, the resistive fluid, which is injected prior to the imposition of electric potential, is viscous or congealing in nature so that it tends to act as a plugging agent in those parts of the reservoir that it enters. Thus, the subsequent flow of fluids in these relatively depleted portions of the reservoir is impeded, and oil is more readily displaced from the relatively undepleted low permeability layer of the reservoir that is heated by electric current. The conventional electrical analogy is essentially identical to that of the embodiments of FIGS. 4 and 5. The viscous slug does not significantly penetrate the low permeability layer so that subsequent injection of low resistivity liquid and passage of electric current are not significantly inhibited. Materials which can be used for viscous resistive fluid injections include solutions of polyacrylamides or other polymers, emulsions, immiscible microemulsions, gels, foams, muds, slurries, cements and liquid plastics.

The selective heating method of the invention is also useful for altering the drainage pattern of an oil well. One application in which the method of the invention may be used for such purpose is illustrated in FIG. 7. The drawing provides both a plan and sectional elevation view of a formation containing a dipping reservoir having a water (oil-lean) layer in the down-dip and an oil-rich layer containing connate salt water in the up-dip direction. Injection wells A and C are located in the up-dip portion of the reservoir, and the electrodes of a circuit of the type illustrated in FIG. 1 are located at wells A and C within the oil layer. A production well B is located between wells A and C and extends down into the water layer. In order to concentrate current flow in the oil layer, fresh water, or other high resistivity fluid, is pumped into the water layer at the production well so as to increase the resistivity of the water layer. This establishes an electrical circuit of the type analogized at the bottom of FIG. 7, in which there are two resistors in parallel, with the resistor corresponding to the water zone having a substantially lower conductance than that of the resistor corresponding to the oil zone. As low resistivity liquid is injected through wells A and C, and current applied through the electrodes located at the injection wells, selective heating takes place in the oil zone up-dip from production well B, thereby increasing well drainage of the production well in the up-dip direction, away from the water zone.

In an especially important embodiment of the invention, selective electrical resistance heating is utilized to promote recovery of oil from the normally unswept regions of a pattern flood. In a pattern flood, a plurality of injection wells are disposed around a recovery well, and oil contained in a reservoir is moved toward the recovery or production well under the influence of fluid injected at the injection wells. Conventional pattern flood arrangements include 5-spot flood in which each production well is substantially at the center of an array of four injection wells (usually at the corners of a square or at least substantially rectangular quadrilateral), so that the production well recovers oil moved toward it by fluid injected at the four injection wells; and a 7-spot flood, in which a production well is located at substantially the center of a hexagonal array of injection wells, and operation is otherwise similar to that of a 5-spot flood.

Figure 9:
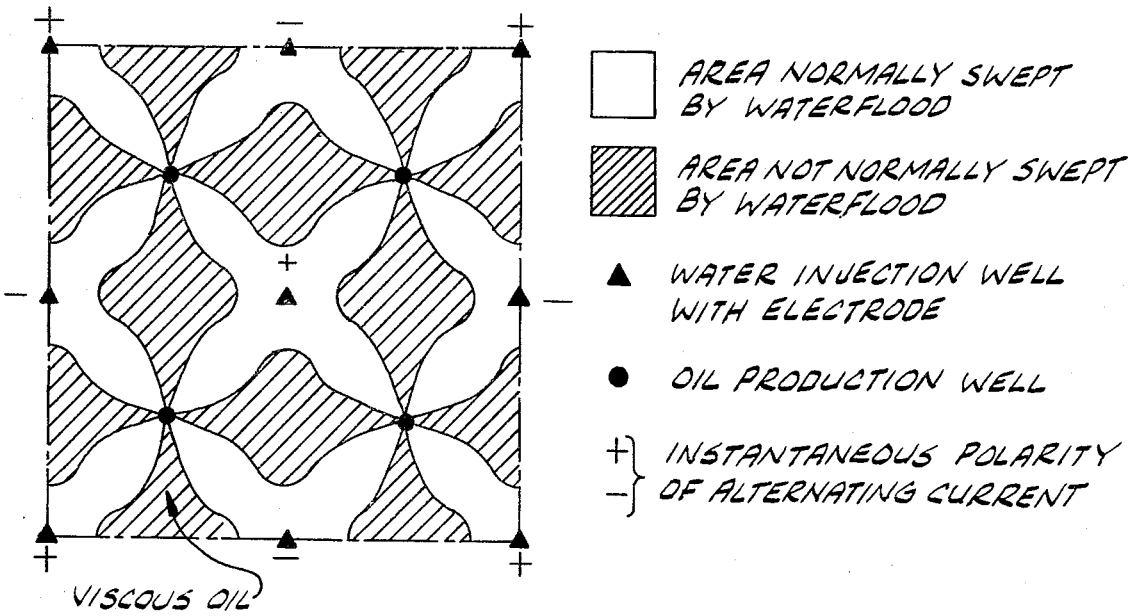

As illustrated in FIGS. 8 and 9, pattern flooding effectively sweeps a formation in an area extending on either side of each line between an injection well and a production well. However, because the injected fluid proceeds generally along this line, the region outside this area, i.e., the region centered about the midpoint between adjacent injection wells, normally remains unswept. The embodiment of the invention relating to pattern flooding provides an electrical circuit through this normally unswept portion for selective heating thereof, so as to reduce the viscosity of oil contained therein and promote its recovery by the injected fluid. Selective heating of this area causes thermal expansion of oil contained in the area and reduces oil viscosity so that the area is penetrated by injected fluid which would otherwise bypass it, thus forcing oil into the natural path of injected fluid flow so as to cause the oil to flow to the production well.

One particular aspect of this embodiment of the invention focuses on a pair of injection wells located, for example, along one side of a rectangular 5-spot pattern. As schematically illustrated in FIG. 8, this aspect of the invention involves water flooding with a liquid whose resistivity is significantly lower than the resistivity of the connate water in the reservoir. Typically, salt water of a salinity substantially higher than the connate water is used. Salt water injection is commenced before application of current, so that a relatively highly conductive region is established on either side of the normally unswept area. Thus, the electrical analogy is that shown at the bottom of FIG. 8, in which there are three resistors in series, with those at the injection wells being relatively conductive, and the power consumption occurs primarily in the normally unswept region or portion of the reservoir on a line between the two injection wells. In this embodiment of the invention, there need not be any prior injection of high resistivity fluid, as there is in the case of the layered reservoir or where alteration of well drainage is desired. Typically, this embodiment is a secondary recovery technique, in which low resistivity liquid is injected for purposes of both conventional water flooding and providing an electrical circuit which deviates substantially from the normal fluid flow path. Current passing through this circuit selectively heats the normally unswept portion of the pattern, so as to promote penetration thereof by the injected fluid and increase oil recovery. It should be understood, however, that this embodiment could also be utilized as a tertiary recovery technique wherein the formation is first water flooded or subjected to some other secondary oil recovery technique.

A particularly preferred embodiment of the invention employs a plurality of injection wells disposed about a recovery well with an electrical circuit of the type shown in FIG. 1 established between each injection well and each injection well adjacent thereto in a pattern of alternating polarity. For a 5-spot pattern, this arrangement is illustrated in FIG. 9. After commencement of the injection of low resistivity liquid, alternating current is applied between the electrodes at each adjacent pair of injection wells around the periphery of the array, thereby effecting a directed flow of electric current which causes the selective electrical resistance heating in the normally unswept zone between each of these pairs of injection wells. The low resistivity liquid injected is preferably of a higher conductivity than the connate water, so as to minimize heating near the electrode wells, thereby making more electrical energy available for heating the unswept area of the flood pattern. The alternating polarity pattern of the injection wells thus provides a network of current paths which selectively heat each of the normally unswept portions of the formation and effects a material improvement in the overall recovery from the pattern. Although described and illustrated above in connection with a 5-spot pattern, it will be understood that this embodiment of the invention is equally applicable to a 7-spot pattern or any other similar flooding arrangement. The process is effective even if the reservoir is heterogeneous so that the shape of the unswept area differs substantially from that illustrated in FIG. 9.

Figure 11:
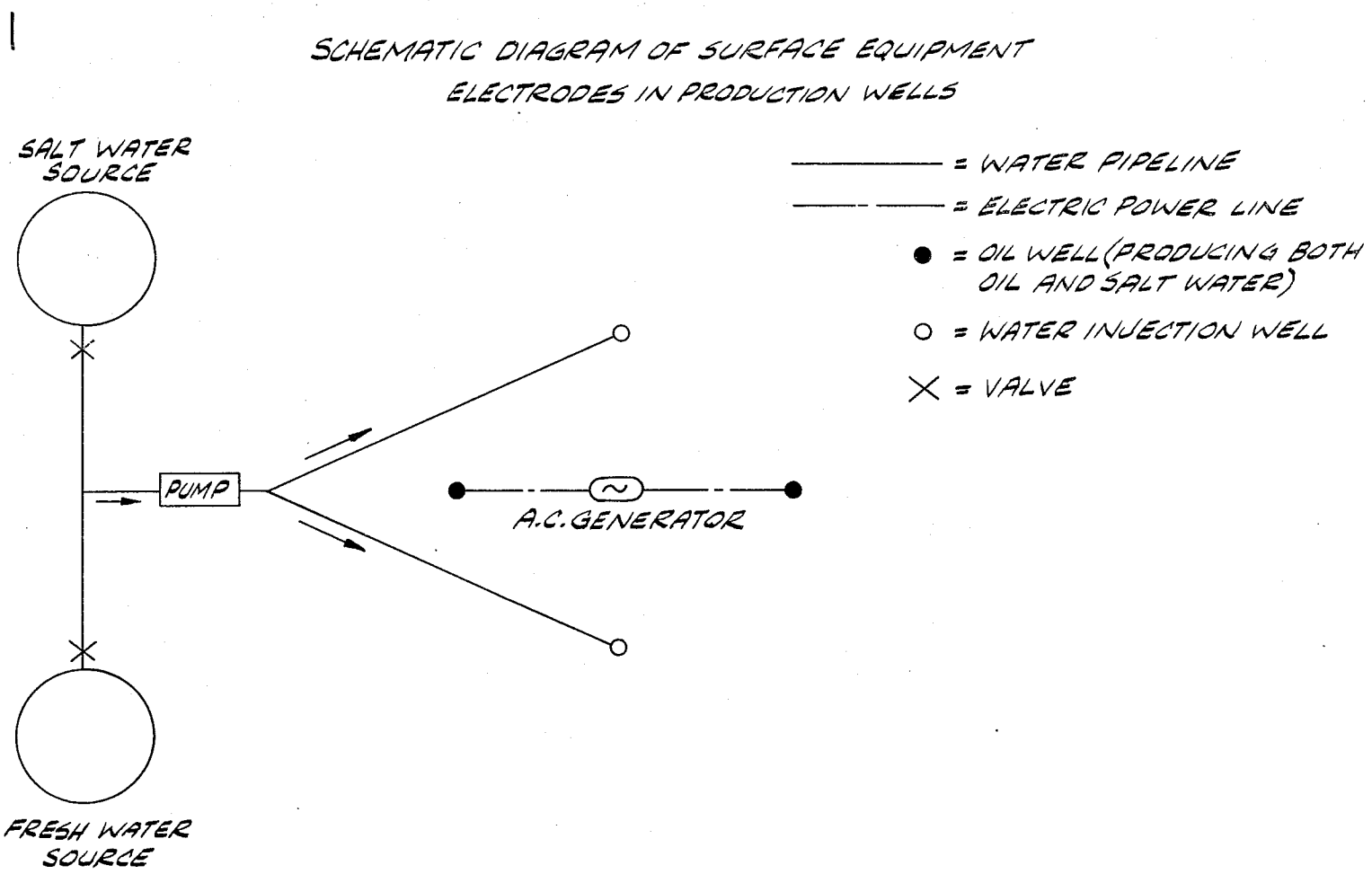
FIG. 11 is a schematic drawing showing the water injection and electrical circuit arrangements for the embodiment of FIG. 10.

Another embodiment of the invention for use in conjunction with a pattern flood is illustrated in FIGS. 10 and 11. In this arrangement, electrodes of alternating polarity are installed in adjacent production wells, rather than in neighboring injection wells. Here selective heating of the normally unswept portions of the pattern is achieved by the passage of current on the lines between production wells, rather than on the lines between adjacent injection wells. In the operation of this embodiment of the invention, a low resistivity liquid (normally salt water) is initially injected in a conventional pattern flood, at least until this liquid breaks through to the production well. At this point, the resistivity is low at production wells A and C of FIG. 10 so that current passing along a path directly from well A to well C generates heat primarily in unswept zone B. In order to reduce the flow of current through the areas surrounding the injection wells, application of current is preferably preceded by injection of a limited amount of fresh water at each injection well, as illustrated in step 2 of FIG. 10. The net effect is to provide a circuit arrangement analogized by the arrangement of resistors shown at the bottom of FIG. 10.

In each of the various embodiments of the invention described above, the recovery of oil from the selectively heated portion of the reservoir may be further promoted or augmented by formation of a gas phase therein as a consequence of heating. Such gas phase may contain water vapor, methane, light hydrocarbons, carbon dioxide and/or hydrogen sulfide. Formation of the gas phase displaces oil from the selectively heated portion so that it can be more readily recovered.

The effect of the evolution of gas during heating is illustrated in FIG. 12 for both nonlayered and layered reservoirs. As indicated, the evolution of gas in a nonlayered reservoir displaces oil either directly toward the production well or toward the naturally predominant flow path for injected liquid, which thereafter readily transports the oil toward the production well. In the case of a layered reservoir without crossflow, evolution of gas cooperates with injected fluid to move oil through that layer to the production well. Where there is a layered reservoir with crossflow, gas evolution tends to displace some of the oil from the selectively heated low permeability zone into the higher permeability zone, where it is readily recovered under the influence of the normal flow of injected fluid through the latter layer. Gas evolution also displaces some oil through the selectively heated low permeability zone to the production well where it is recovered.

Displacement of oil by evolved gas is an efficient process at gas saturation below the critical value. A barrel of evolved gas substantially displaces a barrel of reservoir oil when both the gas and water saturations are below their respective critical saturations. Where gas saturation is above critical, both oil and gas flows occur, and the process becomes markedly less efficient. As a consequence, selective heating should be limited to avoid exceeding the critical gas saturation.

In each of the above-described embodiments of the invention, the selectivity of heating may be enhanced by certain further techniques for reducing the flow of electric current to beds above and below the hydrocarbon and connate water zone. In accordance with these techniques, a resistive fluid is provided in a marginal zone between the portion to be heated and an adjoining region which would otherwise have sufficient conductivity to divert part of the current. Thus, for example, a resistive fluid, such as fresh water, may be injected near the base of the oil zone, or a resistive fluid, typically gas, may be injected near the top of the oil zone. As an alternative to gas injection, a gas phase may be generated at the top of the oil zone by allowing reservoir pressure to decline until the pressure of the oil at the top of the zone is below its bubble point.

The embodiments of this invention are thus effective for the recovery of oil from various formations in which portions of a crude oil reservoir are low in permeability, or otherwise would not be effectively contacted by injected fluids. The method of the invention is effective for reaching deep reservoirs, efficiently recovering oil from layered reservoirs where permeabilities of the various layers are unequal, and improving the effectiveness of a pattern flood. In the case of a layered reservoir, the method does not require prior identification of which layers are more permeable and which are less permeable. In the case of a pattern flood, this method heats the unswept area even if the location of this area is not accurately known, such as in a water flood of a heterogeneous reservoir. The method of the invention is also useful for altering the drainage pattern of a well so that oil recovery will be increased. Moreover, the various techniques disclosed herein are advantageous regardless of the presence or absence of vertical communication between zones in a reservoir, unlike the prior art methods of selective plugging of permeable zones or selective well completion which are useful only in the absence of any such vertical communication. Most significantly, the selective electrical resistance heating method of the invention provides much more efficient utilization of electrical energy than prior art electrical methods which involve general heating of a formation or use of electricity for the limited purpose of generating steam or other heated fluid.

The following examples illustrate the invention.

EXAMPLE 1

Figure 13:
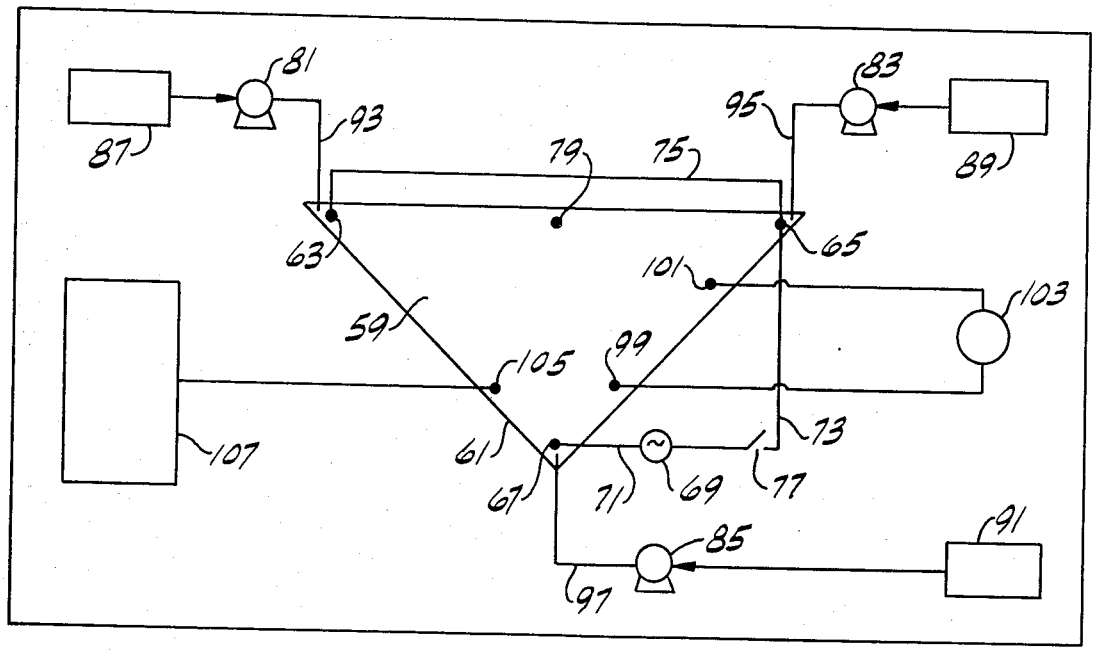
FIG. 13 is a schematic drawing showing the laboratory equipment arrangement for a laboratory simulation of certain embodiments of the invention.

The embodiment of the invention wherein selective electrical resistance heating is utilized to facilitate recovery of oil from the normally unswept portions of a pattern flood was demonstrated by laboratory simulation using the apparatus illustrated in FIG. 13. As shown in the figure, the simulation was conducted in a right triangular sand pack 59, which represented one-half of a 5-spot pattern. Sand pack 59 was contained in a Lucite triangular container 61. Water injection wells 63, 65 and 67 were located at the corners of the sand pack, and these wells were equipped with electrodes so that, as water was injected, an electric potential generated at an alternating current source 69 could be applied between the injection wells through electrical power connections 71, 73 and 75 upon closure of a switch 77. A production well 79 was located at the midpoint of the hypotenuse of the triangular sand pack, corresponding to the center of the square of a 5-spot pattern flooding system. Three positive displacement feed pumps 81, 83 and 85 were provided for delivery of feed materials from containers 87, 89 and 91 through delivery lines 93, 95 and 97 to injection wells 63, 65 and 67, respectively. In order to reduce the surging that would otherwise arise from operation of the positive displacement pumps, a small air chamber (not shown) was installed on the delivery line of each pump.

Figure 14:
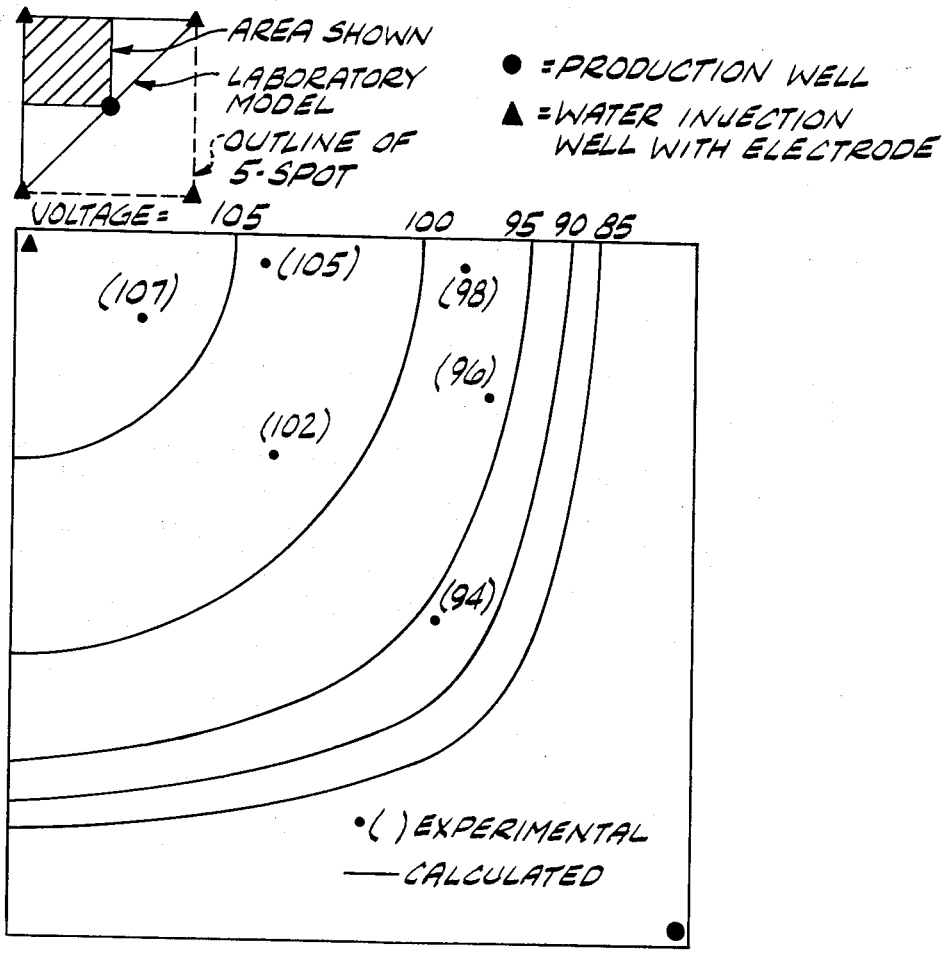
FIG. 14 shows the potential distribution during the simulation of Example 1 after electrical resistance heating for 0.17 minutes in a square section of the apparatus of FIG. 13 corresponding to a quadrant of a 5-spot pattern, with the production well at the lower right-hand corner of the quadrant and an injection well at the diagonally opposite corner.

Graphite was used as the material of construction for the electrodes through which electric current was introduced to the sand pack at each injection well. Electric potential was measured at eleven small graphite electrodes, two of which are shown schematically at 99 and 101 connected to voltmeter 103 in FIG. 13, while the exact locations of six of the measuring electrodes are shown in FIG. 14. A graphite spray coating was used to protect the steel injection well casings against corrosion.

Figure 16:
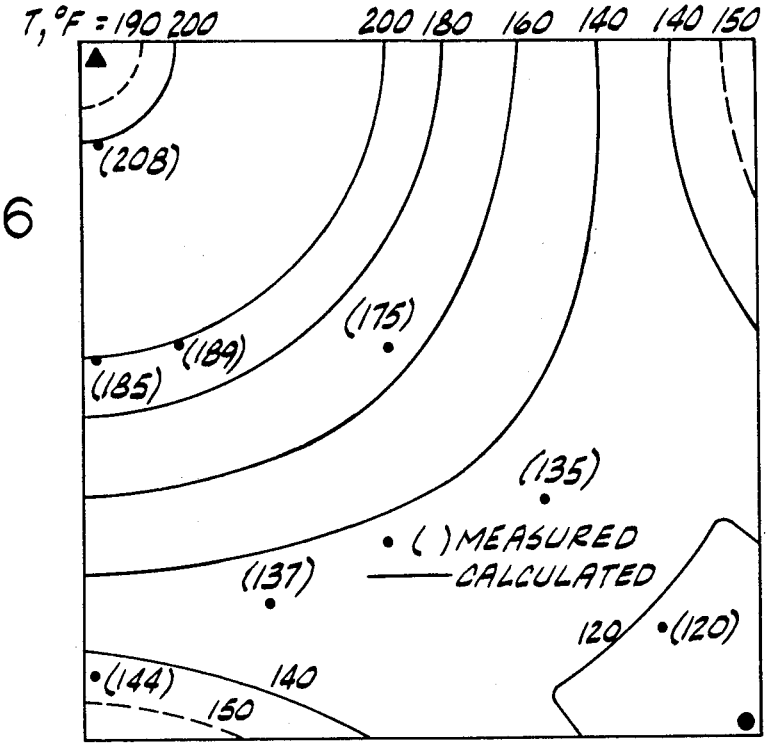
FIG. 16 shows the temperature distribution during Example 1 after electrical resistance heating for 29.5 minutes in the same square section of the apparatus as that shown in FIGS. 14 and 15.

Twelve iron/constantan thermocouples were installed to measure temperature. One of these is shown schematically at 105 in FIGS. 13, connected to a temperature recorder 107, and the exact locations of eight of the thermocouples is illustrated in FIG. 16.

Internal dimensions of sand pack 59 were 30 in.×30 in.×42.42 in.×1.6 in. The pack consisted of 70–100 mesh silicon sand, which had a porosity of 37.6% and a permeability of approximately 11.5 darcys.

Based on theoretical equations for fluid flow, current flow, heat flow, salt concentration and electrical resistivity, a mathematical model was developed to predict potential distributions, temperature distributions and oil recovery as a function of time for defined oil characteristics, injected water salinity, water flow rate and applied potential. Simulations subsequently carried out confirmed the accuracy of the mathematical model and demonstrated its effectiveness for evaluating performance in various types of geologic formations containing crude oil reservoirs for which selective electrical resistance heating would be desirable for facilitating oil recovery.

Using the apparatus of FIG. 13, five laboratory experiments were conducted in order to obtain data that could be compared to the performance predicted by the mathematical model. Electric potentials and temperatures within the sand pack were measured during these tests. The pack was 100% water saturated for the first three experiments. For the final two tests, oil and water saturation were 86% and 14%, respectively.

During the first experiment, an electric potential was applied without water injection so that heat transfer by forced convection was zero. Water was injected simultaneously with electrical heating during the second experiment, so that heat transfer resulted from both conduction and convection. Water salinity was uniform in the second test. During the third experiment, relatively fresh water was introduced into a system that had initially been saturated with salt water. The fourth experiment was a conventional water flood, and the fifth and final test was a laboratory simulation of selective heating. Laboratory procedures for the fourth and fifth experiments were identical, except for the use of electrical resistance heating in the final test.

For each of the experiments of this example, satisfactory agreement between the performance of the laboratory simulation and the calculations from the mathematical model was demonstrated.

In the final test in which selective electrical resistance heating was demonstrated, the sand pack was initially saturated with water containing 16,500 ppm sodium chloride, then flooded with a synthetic oil until an oil saturation of 86% was achieved. Oil viscosity was 15 centipoises at 60° F. After saturation of the sand pack with oil and with water containing 16,500 ppm sodium chloride, water containing 1000 ppm sodium chloride was injected until water breakthrough. Total water injected during this step was 1500 cc. Next, low resistivity water containing 200,000 ppm sodium chloride was injected into the sand pack for 14 minutes. A total of 1120 cc of saline water was injected in this step. Thereafter, a 110 v alternating current supply was provided at the electrodes, and electrical heating with continued injection of 200,000 ppm sodium chloride brine was carried out for 30 minutes. Application of current was then discontinued, but unheated water injection was continued until a total of approximately three pore volumes (28,094 cc) had been injected.

Figure 15:
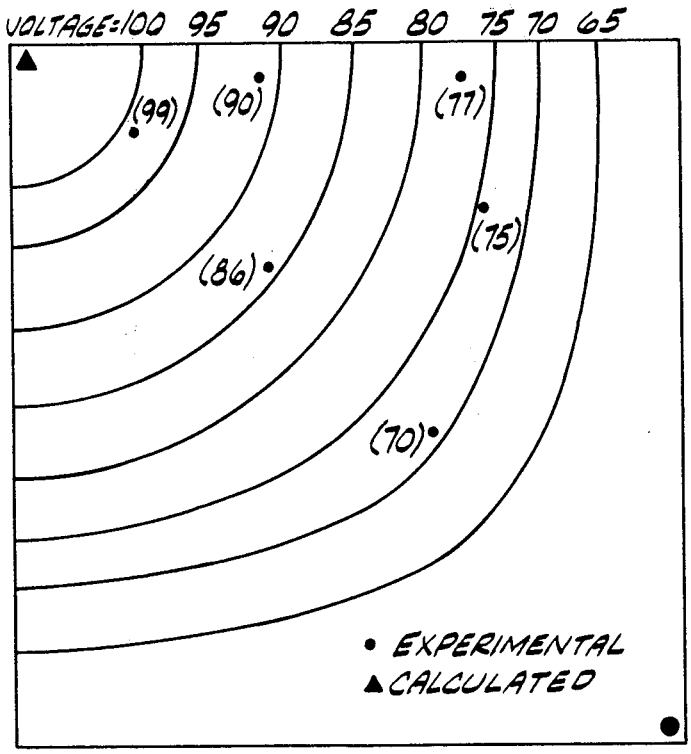
FIG. 15 shows the electrical potential distribution during Example 1 after electrical resistance heating for 29.5 minutes in the same square section of the experimental system as that shown in FIG. 14.
Figure 17:
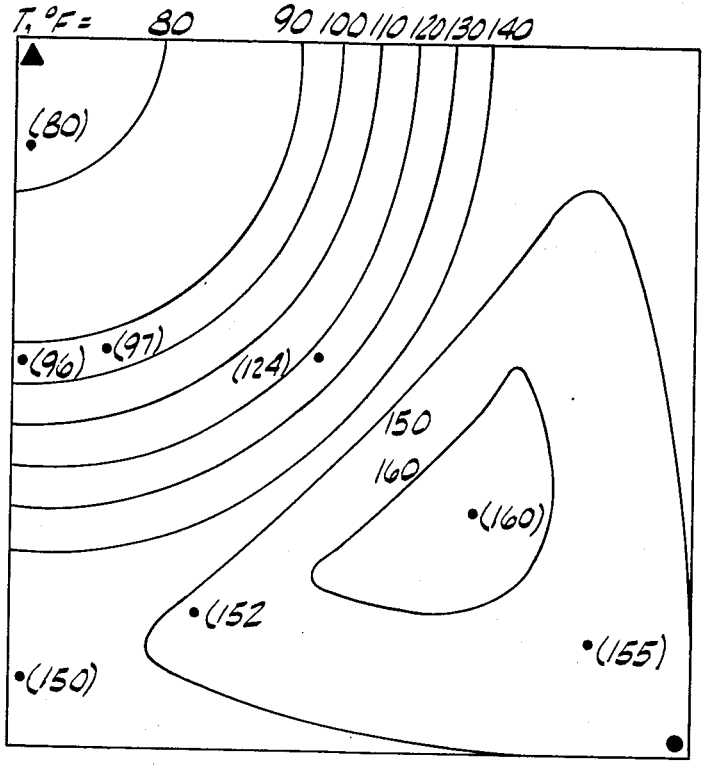
FIG. 17 shows the temperature distribution during Example 1 after discontinuance of electrical resistance heating an injection of unheated water for 34.33 minutes in the same square section as that shown in FIGS. 14, 15 and 16.
Figure 18:
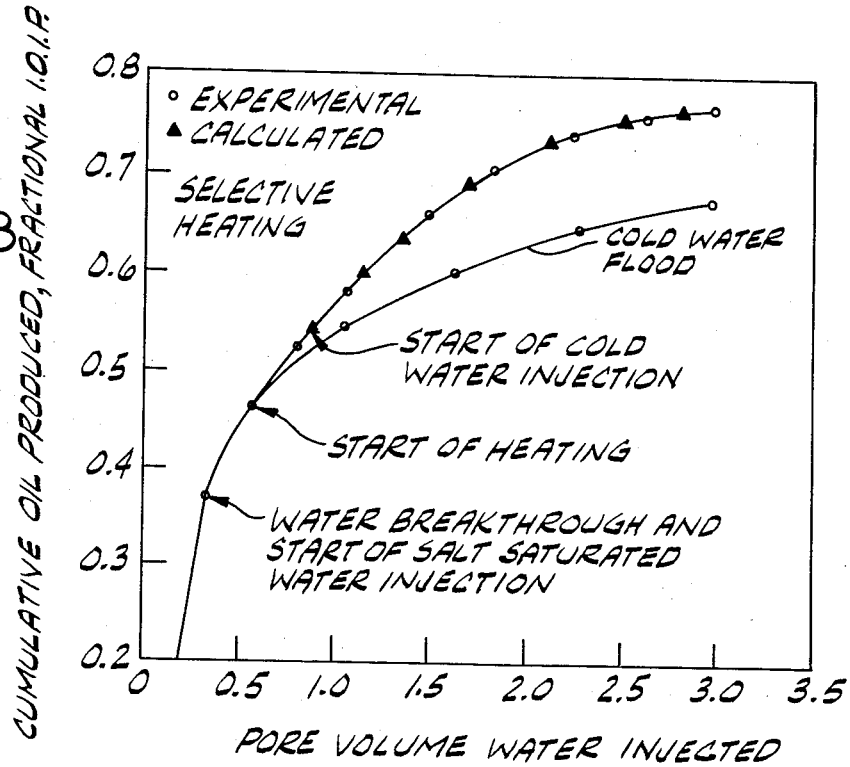
FIG. 18 shows the experimental results for cumulative oil produced, expressed as fractions of initial oil in place (I.O.I.P.), vs. pore volume of water injected for both the heated and unheated water floods of Example 1.

FIG. 14 shows a comparison of computed and measured electric potential within the sand pack 0.17 minutes after electrical heating was begun. The contours in the figure are based on computer calculations utilizing the mathematical model, and the data points were measured with the voltmeter. FIG. 15 shows a similar comparison of computed and measured voltages after 29.5 minutes of electrical heating with brine injection. FIG. 16 shows a comparison of computed and measured temperatures after 29.5 minutes of electrical heating. FIG. 17 compares computed and measured temperatures after electrical heating has been terminated and brine had been subsequently injected for 34.33 minutes. FIG. 18 compares the computed and measured oil production for the demonstration study. The latter figure also provides a comparison between oil recovered by the selective heating process and oil recovered with a conventional unheated water flood (the fourth experiment). Oil recovery with selective heating was found to be 13% greater than oil recovery for the unheated water flood.

The mathematical model developed was determined to be adequate for prediction of performance of selective electrical resistance heating of desired portions of crude oil reservoirs. FIGS. 14 to 18 demonstrate that the process employed is effective for heating portions of a pattern flood that cannot be adequately heated by hot fluid injection. This is evidenced in the relatively high temperature shown in the upper right and lower left corners of FIGS. 16 and 17. These corners are the midpoints of regions that would not normally be swept in a pattern flood. Thus, a temperature increase of approximately 75° F. was achieved in portions of the flood pattern that cannot normally be contacted by injected fluids.

EXAMPLE 2

The mathematical model whose accuracy had been demonstrated in accordance with Example 1 was used to predict the performance of the selective heating process in a hypothetical oil reservoir (Field Case I). In the case of this example, a 5-spot water flood was utilized for recovery of oil from a reservoir containing moderately viscous oil. The productive formation was bounded above and below by rocks with high electrical resistivity. Reservoir water salinity was relatively low, and a slug of highly saline water was injected prior to application of electric potential. Selective heating was thereafter carried out for the purpose of heating a region separate from the naturally predominant path for flow from injection wells to production wells, so that this normally unswept portion would be contacted by the injected liquid of the water flood and oil recovery thereby increased. The conditions of the hypothetical reservoir are set forth in Table I.

TABLE I

| Reservoir Characteristics Hypothetical Field Case I | |
|---|---|
| Well Spacing, Ft | 450 |
| Reservoir Thickness, Ft | 100 |
| Porosity, Fraction | 0.3 |
| Absolute Permeability, darcys | 0.6 |
| Initial Oil Saturation, Fractional Pore Volume | 0.8 |
| Initial Water Saturation, Fractional Pore Volume | 0.2 |
| Initial Reservoir Pressure, psi | 3,000 |
| Initial Reservoir Temperature, °F. | 130 |
| Oil Viscosity @ 130° F., cp | 50 |
| Solution Gas/Oil Ratio, SCF/STB | 200 |
| Initial Water Salinity, ppm NaCl | 16,500 |
| Thermal Conductivity of Adjacent Strata, BTU/hr-ft-°F. | 0.45 |

The recovery process was commenced by injection of saline water (200,000 ppm sodium chloride) at a rate of 800 barrels per injection well per day. Since liquid injected at each well dispersed in a substantially uniform radial pattern from each well, 200 barrels per day entered the 5-spot pattern from each of the four injection wells thereof. When water breakthrough occurred, electrical heating was begun using a 1000 v alternating current source with electrodes in the injection wells. Heating was discontinued after 42 days and water injection continued until 0.70 pore volume had been injected. Water salinity and injection rates were held constant throughout the simulation. In another identical 5-spot pattern system, an unheated water flood was carried out in order to provide a basis for comparison with the flood that was assisted by selective heating. The parameters of the unheated flooding operation were identical to those described above, except for the omission of electric current.

Figure 19:
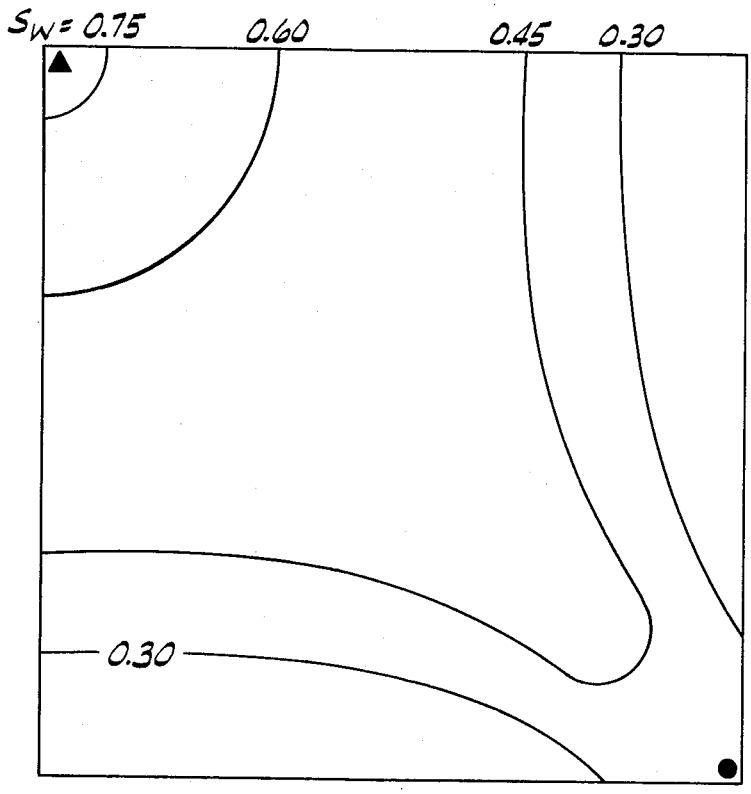
FIG. 19 shows the water saturation profiles, for a quadrant comparable to that of FIG. 14, at a time prior to electrical resistance heating in computer simulated Field Case I (described in Example 2)
Figure 20:
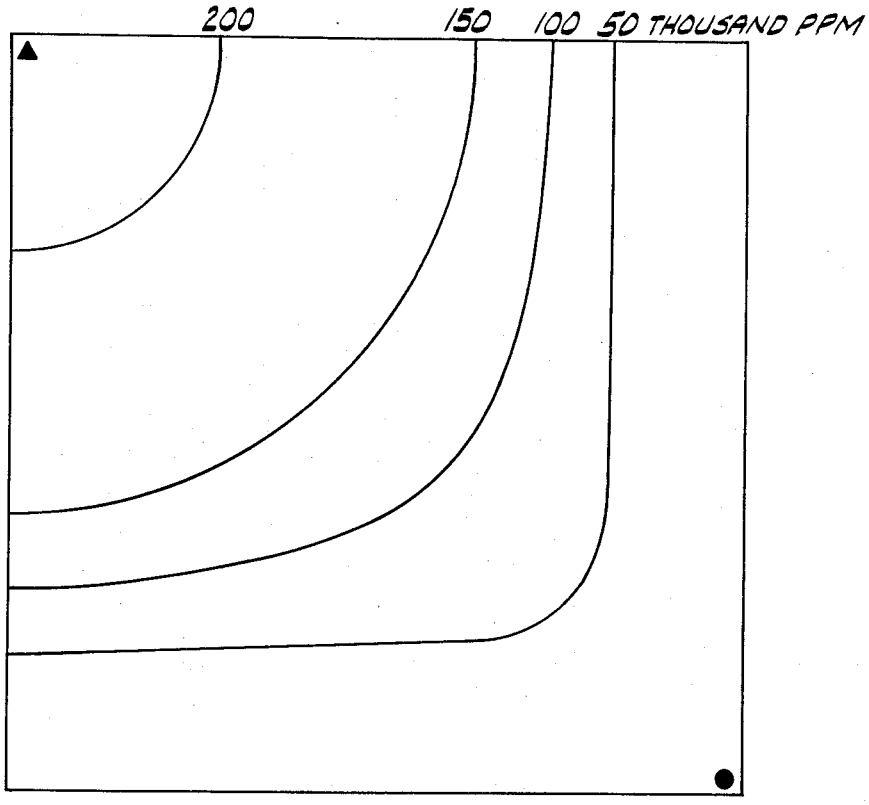
FIG. 20 shows the salt concentration profiles for the quadrant of FIG. 19 prior to resistance heating for Field Case I.
Figure 21:
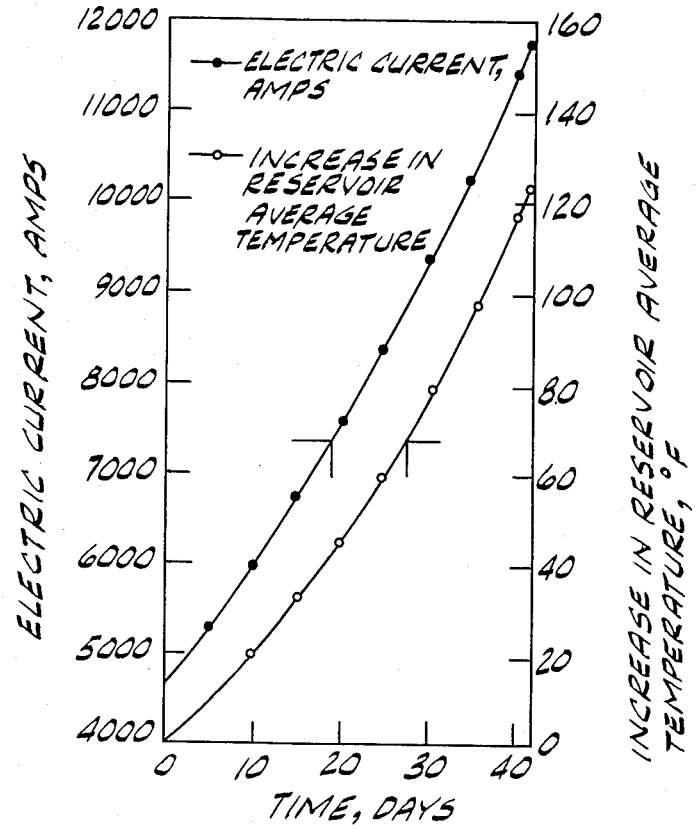
FIG. 21 shows the current and increase in average reservoir temperature as functions of time for Field Case I.

FIG. 19 shows the water saturation distribution in one quadrant of the pattern at the time heating was begun, and FIG. 20 shows the corresponding salinity distribution. Since the electrical resistance of the system decreased as saline water was injected, current flow increased continuously during the 42 days of heating. This effect is shown in FIG. 21, which also shows that the average reservoir temperature was increased 121.5° F. by electrical heating.

Figure 22:
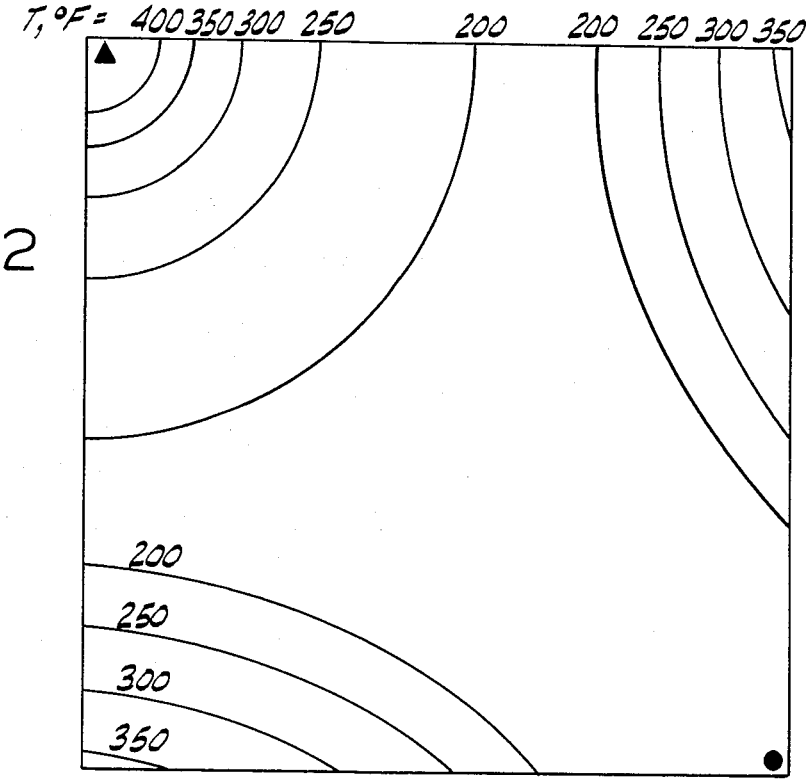
FIG. 22 shows the temperature distribution in the quadrant of FIG. 19 after heating for Field Case I.

FIG. 22 shows the temperature distribution in the aforesaid quadrant at the end of the heating process and demonstrates that the method of the invention is effective in selectively heating those regions that would not normally be swept by a water flood. This is particularly indicated by the high temperatures in the upper right and lower left corners of the figure, which correspond to midpoints along the lines between adjacent injection wells. Because the current density is necessarily high near the injection wells, temperatures are also high in these regions.

Figure 23:
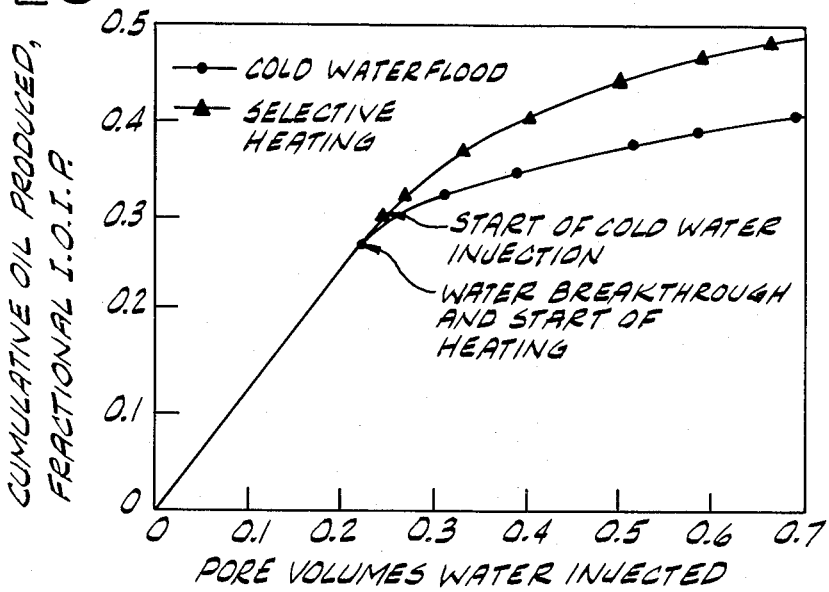
FIG. 23 shows cumulative oil production (fraction I.O.I.P.) vs. pore volume water injected for both Field Case I and an otherwise comparable but unheated computer simulated water flood.

FIG. 23 shows cumulative oil recovery as a function of pore volumes of water injected for both the unheated water flood of this example and that assisted by selective heating. As established by calculations from the mathematical model and illustrated in FIG. 23, selective heating increases oil recovery by roughly 55,000 stock tank barrels.

EXAMPLE 3

Another hypothetical field case was simulated using the mathematical model demonstrated in Example 1. In this instance (Field Case II), a 5-spot water flood was utilized in a two-layered reservoir. The upper layer was overlain by a high resistivity formation and a similar type of rock underlay the lower oil zone. The upper layer was substantially more permeable than the lower. In a standard unheated water flood, the upper high permeability layer would have been depleted much more rapidly than the less permeable layer, and the attempt to recover oil by water flood would have become uneconomical because of the high water/oil ratio reached before any substantial fraction of the oil could have been recovered from the lower zone. A similar problem would arise if the reservoir were produced by steam injection or by prior art (non-selective) electric reservoir heating.

Reservoir water salinity was high, and a slug of fresh water was injected prior to initiation of electrical resistance heating. This procedure was intended to increase oil recovery by concentrating the heating effect in the less permeable layer.

The reservoir conditions for the case of this example are set forth in Table II. The nature of the hypothetical formation was such that fluid and energy transfers between the two layers were not great enough to significantly influence the recovery process.

TABLE II

| Reservoir Characteristics Hypothetical Field Case II | |
|---|---|
| Well spacing, ft (distance between like wells) | 500 |
| Thickness, ft: | |
| Less Permeable Layer | 100 |
| More Permeable Layer | 100 |
| Porosity, fraction: | |
| Less Permeable Layer | 0.30 |
| More Permeable Layer | 0.32 |
| Absolute Permeability, darcys: | |
| Less Permeable Layer | 0.40 |
| More Permeable Layer | 1.20 |
| Initial Oil Saturation, fractional pore volume: | |
| Less Permeable Layer | 0.75 |
| More Permeable Layer | 0.80 |
| Initial Water Saturation, fractional pore volume: | |
| Less Permeable Layer | 0.25 |

TABLE II-continued

| Reservoir Characteristics Hypothetical Field Case II | |
|---|---|
| More Permeable Layer | 0.20 |
| Initial Reservoir Pressure, psi | 3,000 |
| Initial Reservoir Temperature, °F. | 110 |
| Oil Viscosity @110° F., cp | 50 |
| Solution Gas/Oil Ratio, SCF, S7B | 150 |
| Initial Salt Concentration of Connate water, ppm | 200,000 |
| Thermal Conductivity of Adjacent Strata, BTU/hr.ft.°F. | 0.45 |

In carrying out the method of this example, low salinity water (1000 ppm sodium chloride) was pumped into the injection wells, which were completed in such fashion that the water could enter both the low and high permeability zones. A constant injection rate of 400 barrels per day was maintained in the less permeable zone, with injection rate in the more permeable layer varying with changes in pressure and saturation. Injection of low salinity water was discontinued when the cumulative volume injected in the more permeable layer reached 0.8 pore volume. Thereafter, high salinity water (200,000 ppm sodium chloride) was injected.

A 2000 v alternating current supply was connected to electrodes placed in the injection wells, and current applied as soon as high salinity water injection was begun. The 2000 v potential was maintained for 11 days, after which the emf was reduced to 1250 v and heating was continued for an additional 17 days.

Conventional water flooding was begun when heating was discontinued. Water injection at the previously specified rates was continued until the water/oil ratio produced by the combined layers, as observed at the production well, increased to 27.8. Water flooding operation was then terminated.

Figure 24:
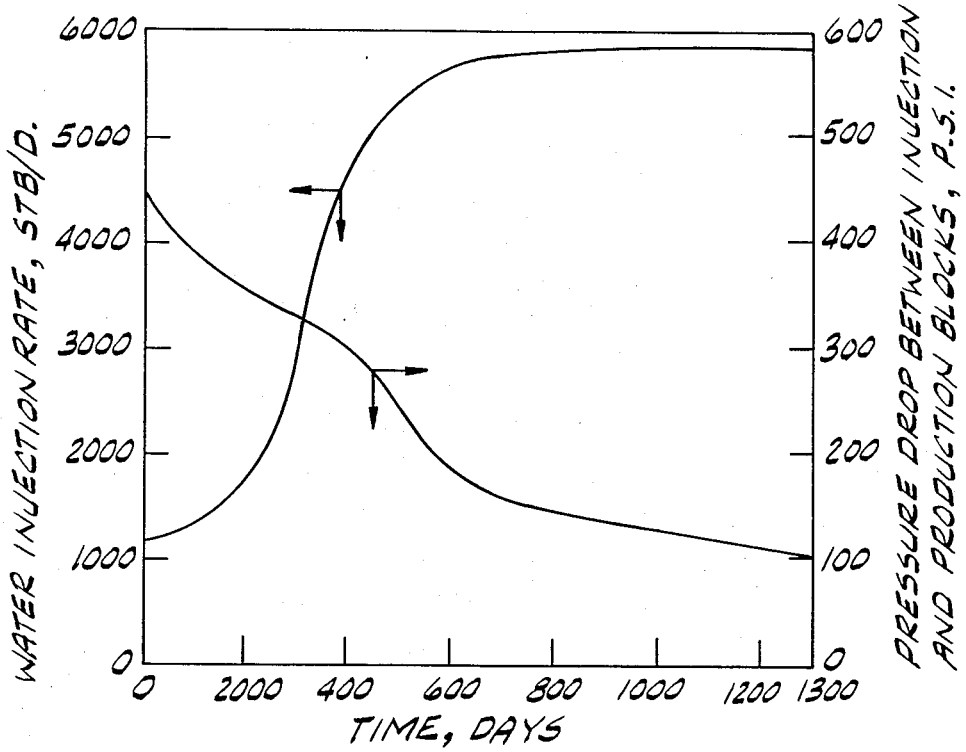
FIG. 24 shows water injection rate and pressure drop between injection and production well blocks as a function of time for computer simulated Field Case II (as described in Example 3)

Since the two oil zones were open to well pressure at both the injection and the production wells, the pressure differential between these two wells would be virtually the same in the high permeability layer as in the low permeability layer. This condition was approximated in the simulation by assuming that the pressure differential between the simulation grid blocks containing production and injection wells was the same for both layers. FIG. 24 shows the pressure differential between production and injection grid blocks, as well as the rate of water injection in the more permeable layer.

Figure 25:
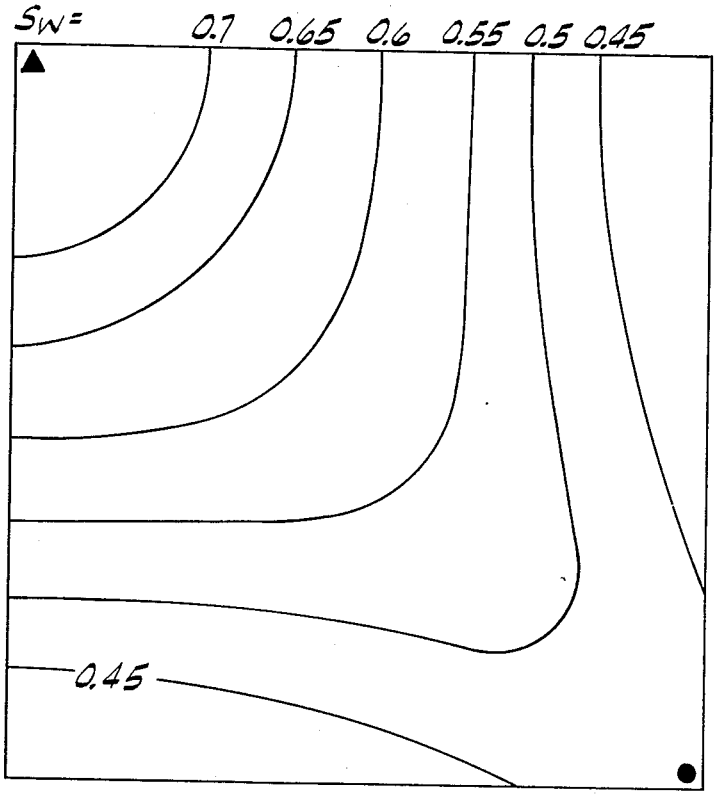
FIG. 25 shows water saturation distribution, in a quadrant comparable to that of FIG. 19, for the more permeable layer of a layered reservoir prior to electrical resistance heating in Field Case II.
Figure 26:
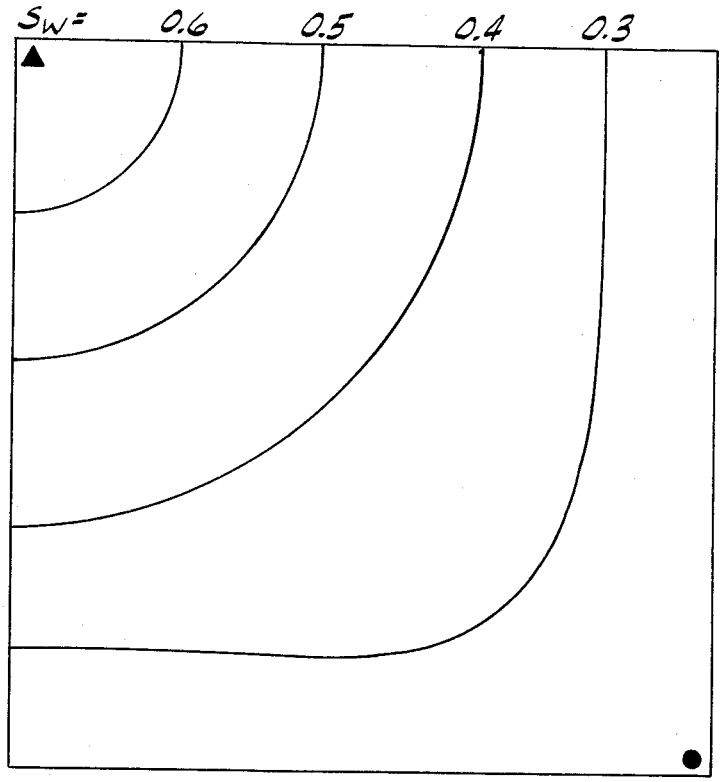
FIG. 26 shows water saturation distribution in the quadrant of FIG. 25 for the less permeable layer prior to electrical resistance heating in Field Case II.

FIGS. 25 and 26 show the calculated water saturation distribution in each layer after injection of the initial fresh water slug. As expected, water saturation was substantially greater in the more permeable zone.

Figure 27:
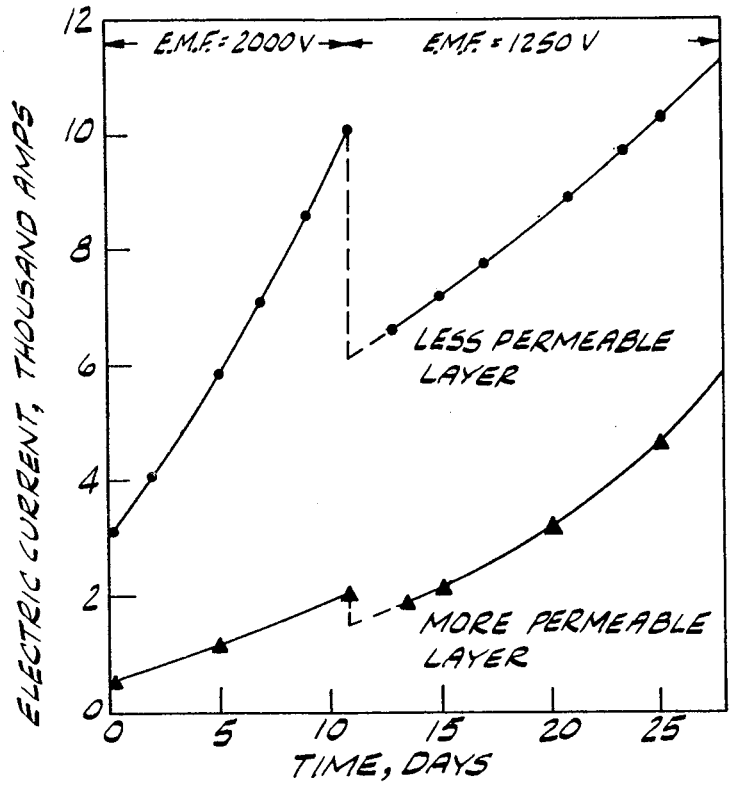
FIG. 27 shows electrical current vs. time for both the more permeable and the less permeable layer of a layered reservoir during electrical resistance heating in Field Case II.
Figure 28:
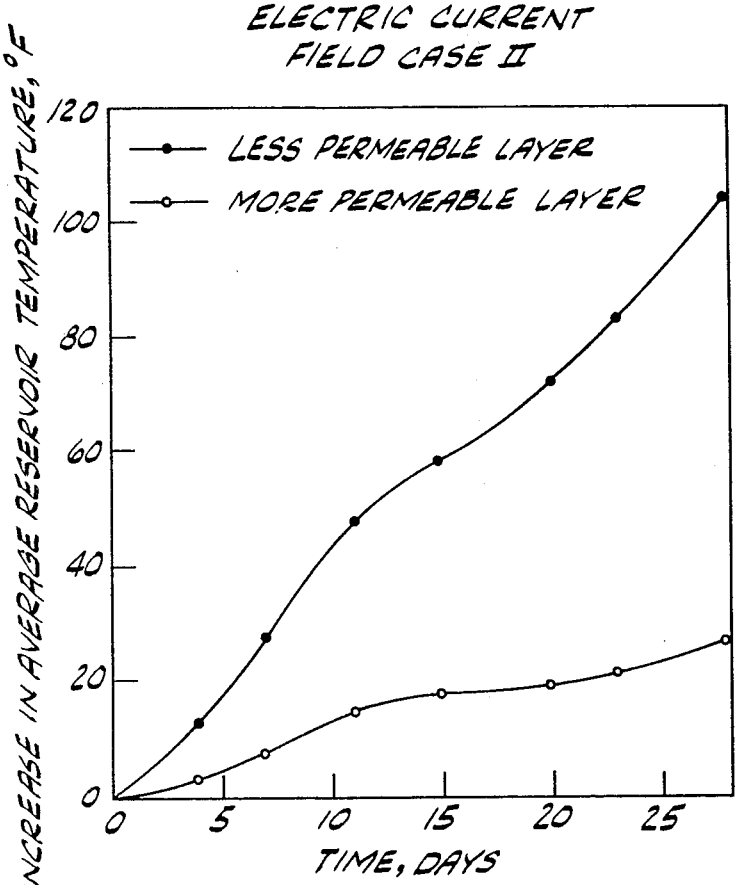
FIG. 28 shows the increase in average reservoir temperature as a function of time for both the more permeable and the less permeable layers in Field Case II.

FIG. 27 shows electric current flowing in each of the two layers as a function of time. This figure suggests that the initial fresh water slug was effective in causing most of the current to enter the less permeable zone. As illustrated in FIG. 28, the process was effective for raising the temperature of the less permeable zone by about 105° F., while the average temperature of the more permeable zone increased only by about 29° F.

Figure 29:
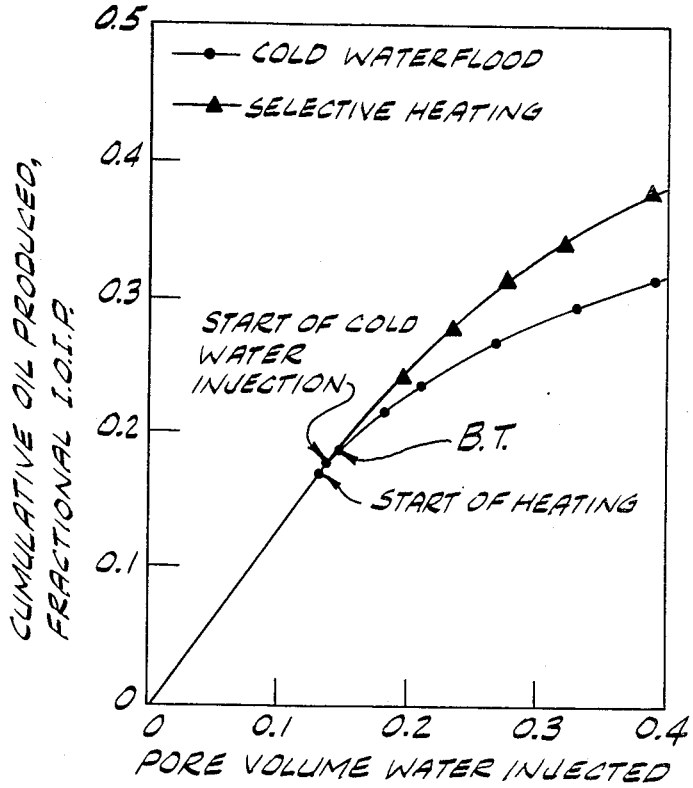
FIG. 29 shows cumulative oil produced (fraction I.O.I.P.) from the less permeable layer as a function of total pore volumes of water injected for both Field Case II and an otherwise comparable but unheated water flood.
Figure 30:
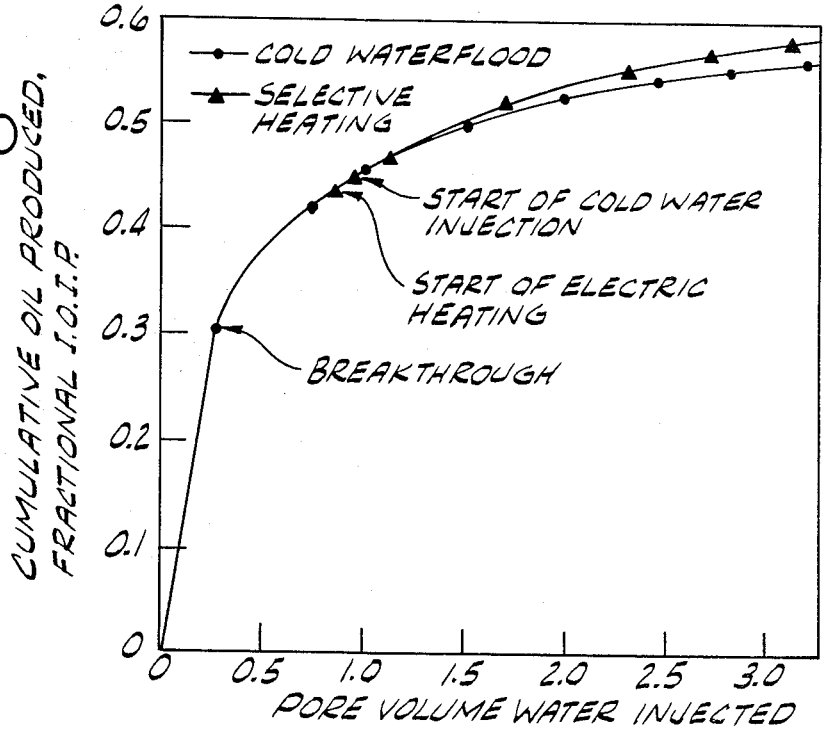
FIG. 30 provides the same information for the more permeable layer that FIG. 29 provides for the less permeable layer.

As in Example 2, a comparative case was carried out using a conventional water flood with no electric heating in order to provide a comparison in evaluating the performance of the selective heating process. This comparison is illustrated by FIGS. 29 and 30 for the less permeable and more permeable layers, respectively. Another comparison is provided by Table III.

TABLE III

| Comparison of Water Flood and Selective Heating Process Hypothetical Field Case II | |
|---|---|
| Less Permeable Layer | |
| Additional Oil Produced, STB | 53,538 |
| More Permeable Layer | |
| Additional Oil Produced, STB | 7,864 |

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. A method for facilitating recovery of oil from a crude oil reservoir by selective electrical resistance heating of a portion of the reservoir which would normally be substantially bypassed by fluid injected into the formation in which the reservoir is located, the method comprising the steps of:

establishing a series electrical circuit for passing current through the formation along a directed path differing from the naturally predominant path of injected fluid flow, said naturally predominant path being substantially occupied by high resitivity fluid, said circuit comprising:

a source of alternating current electric power, a first subterranean electrode electrically connected to one terminal of said source and located in or in proximity to a first well in said formation, a second subterranean electrode electrically connected to the other terminal of said source and located in or in proximity to a second well in said formation, and a portion of an oil reservoir in said formation that contains oil and water and is located between said electrodes substantially separate from a naturally predominant path for flow of injected fluids from an injection well through said formation but affords a current path of lesser electrical resistance between said electrodes than that along said naturally predominant path or any alternative path through the formation that is entirely outside said portion;

injecting a low resistivity liquid through an injection well into a region of said formation that forms a part of said circuit in series with said first electrode and said portion; and passing alternating current from said power source through said circuit so as to cause selective electrical resistance heating of said portion, whereby the resistance to the flow of oil contained in said portion is reduced and oil is swept out of said portion by said low resistivity liquid.

2. A method for recovering additional oil from a geologic formation which has been subjected to a prior injection of high resistivity fluid through an injection well for recovery of oil from a recovery well to which oil has been moved by reservoir pressure and the force of said high resistivity injected fluid, the method comprising the steps of:

establishing a series electrical circuit comprising:

a source of alternating current electrical power, a first subterranean electrode electrically connected to one terminal of said source and located in said formation in or in proximity to a first well in said formation, a second subterranean electrode electrically connected to the other terminal of said source and located in said formation in or in proximity to a second well in said formation, and a portion of an oil reservoir, located between said electrodes in said formation, that contains oil and salt water and has been substantially bypassed by the injection of said high resistivity fluid;

injecting a low resistivity liquid through an injection well into a region of said formation that forms a part of said circuit in series with said first electrode and said portion; and passing alternating current from said power source through said circuit so as to cause selective electrical resistance heating of said portion, whereby the resistance to the flow of oil contained in said portion is reduced and oil is swept out of said portion by said low resistivity liquid.

3. A method for recovering additional oil from a layered crude oil reservoir having layers of unequal permeabilities in a geologic formation that has been subjected to prior injection of a high resistivity fluid through an injection well for removal of oil from the reservoir to a recovery well where it is produced, the method comprising the steps of:

establishing a series electric circuit comprising:

a source of alternating current electric power, a first subterranean electrode electrically connected to one terminal of said source and located in said formation in or in proximity to a first well in said formation, a second subterranean electrode electrically connected to the other terminal of said source and located in said formation in or in proximity to a second well in said formation; and a relatively low permeability layer of a reservoir, located between said electrodes in said formation, that contains oil and salt water and has been substantially bypassed by the injection of said high resistivity fluid;

injecting a low resistivity liquid through an injection well into a region of said formation that forms a part of said circuit in series with said first electrode and said portion; and passing alternating current from said power source through said circuit so as to cause selective electrical resistance heating of said low permeability layer, whereby the resistance to the flow of oil contained in said layer is reduced and said oil is swept out of said layer by said low resistivity liquid.

4. A method as set forth in claim 1, 2 or 3 wherein said first well is an injection well through which said low resistivity liquid is injected.

5. A method as set forth in claim 4 wherein said high resistivity fluid is substantially fresh water.

6. A method as set forth in claim 4 wherein said high resistivity fluid comprises a fluid miscible with oil, whereby removal of oil from the low permeability layer is facilitated by the solvent action of said miscible liquid.

7. A method as set forth in claim 6 wherein said miscible high resistivity fluid is selected from the group consisting of alcohols, miscible microemulsions, liquid hydrocarbons, liquefied hydrocarbon gases, high pressure gas, rich gas, liquefied carbon dioxide, and liquefied hydrogen sulfide.

8. A method as set forth in claim 4 wherein said high resistivity fluid comprises a viscous liquid which serves as a plugging agent and impedes the subsequently injected low resistivity liquid from flowing into the high permeability layer so as to facilitate recovery from the low permeability layer through the action of the low resistivity liquid.

9. A method as set forth in claim 4 wherein said second well is a recovery well.

10. A method as set forth in claim 1, 2 or 3 wherein the resistivity of said low resitivity liquid is lower than the resitivity of said water.

11. A method as set forth in claim 1, 2 or 3 wherein low resistivity liquid is continuously injected during electrical resistance heating so that convection heating arising from penetration of heated low resistivity liquid into said portion contributes to the heating of the oil therein for reducing its viscosity and promoting its recovery.

12. A pattern flooding method for recovering oil from a crude oil reservoir in a geologic formation wherein oil is recovered from a portion of a reservoir that is substantially separate from the naturally predominant path for fluid flow between any injection well and a recovery well in the pattern so that said portion normally is substantially bypassed by injected fluid, the method comprising the steps of:

establishing a series electrical circuit comprising:

a source of alternating current electrical power, a first subterranean electrode electrically connected to one terminal of said source and located in said formation in or in proximity to a first well in said formation, a second subterranean electrode electrically connected to the other terminal of said source and located in said formation in or in proximity to a second well in said formation, and a portion of said reservoir that contains oil and water and is in a region substantially separate from the naturally predominant path for flow of injected fluid from any injection well to any recovery well in said pattern;

injecting through an injection well into a region of said formation that forms a part of said circuit in series with said first electrode and portion a low resistivity liquid having a resistivity less than that of the connate water in said formation; and passing alternating current from said power source through said circuit so as to cause selective electrical resistance heating of said portion whereby the resistance to the flow of oil contained in said portion is reduced and oil is swept out of said portion by said low resistivity liquid.

13. A method as set forth in claim 12 wherein each of said first and second wells is an injection well through which said low resistivity liquid is injected.

14. A method as set forth in claim 13 wherein a pattern comprising a plurality of injection wells is disposed around a recovery well and the electrical polarity of the electrode in or in proximity to each injection well is oppposite that of the electrodes in or in proximity to the adjacent injection wells on either side thereof.

15. A method as set forth in claim 14 wherein the injection wells and recovery well are arranged in a 5-spot pattern comprising four injection wells of alternating electrode polarity at the corners of a substantially rectangular quadrilateral and a recovery well substantially in the center thereof.

16. A method as set forth in claim 14 wherein pattern flooding is commenced by injection of said low resistivity liquid at each injection well and electrical resistance heating is commenced after recovery of oil has begun from along the naturally predominant fluid flow path between the injection wells and the recovery well.

17. A method as set forth in claim 16 wherein simultaneous electrical resistance heating and low resistivity liquid injection are carried out for a period sufficient that convective heating arising from penetration of heated low resistivity liquid into said portion contributes to the heating of the oil in said portion for reducing its viscosity and promoting its recovery.

18. A method as set forth in claim 12 wherein each electrode is located in or in proximity to a production well so that said portion is located along a path between production wells that is normally bypassed by injected fluid.

19. A method as set forth in claim 18 wherein a pattern flood is carried out without application of electrical current until low resistivity liquid breaks through at a production well; fresh water is injected at each injection well after breakthrough so that the conductance along the naturally predominant fluid flow paths between injection and production wells is sufficiently low to significantly limit the flow of current through the areas surrounding the injection wells, and current is thereafter applied in said circuit.

20. A pattern flooding method for recovering oil from a crude oil reservoir in a geologic formation, wherein oil is recovered from a portion substantially separate from the naturally predominant path for flow of injected fluid from any injection well to any recovery well and thus normally bypassed by injected fluid, the method comprising the steps of:

providing a pattern comprising a plurality of injection wells disposed about a recovery well;

establishing between each injection well and each other injection well adjacent thereto in said pattern an electrical circuit comprising:

a source of alternating current electric power, a first subterranean electrode electrically connected to one terminal of said source and located in said formation in or in proximity to a first injection well, a second subterranean electrode electrically connected to the other terminal of said source and located in said formation in or in proximity to an injection well adjacent to said first injection well, whereby the electrical polarity of the electrode in proximity to each injection well in said pattern is opposite that of the electrode at each said adjacent injection well on either side thereof, and a portion of the oil reservoir, located between said electrodes and said formation, that contains oil and water and is substantially separate from the naturally predominant path for flow of injected fluid between either of said injection wells and a recovery well so that said portion would be normally bypassed by injected liquid, injecting low resistivity liquid through said injection wells into regions of said formation that form parts of said circuit in series with said first and second electrodes, respectively, and said portion; and passing alternating current from said power source through each circuit so as to cause selective electrical resistance heating of each said portion whereby the resistance to the flow of oil contained in each portion is reduced and oil is swept out of said portion by said low resistivity liquid.

21. A method as set forth in claim 20 wherein the injection wells and recovery well are arranged in a 5-spot pattern comprising four injection wells of alternating electrode polarity at the corners of a substantially rectangular quadrilateral and a recovery well substantially in the center thereof.

22. A method for selectively heating a relatively oil-rich portion of a crude oil reservoir in a geologic formation so as to alter the drainage pattern relative to a well in said formation and facilitate recovery of oil therefrom, the method comprising the steps of:

injecting into a relatively oil-lean portion of said reservoir adjacent said rich portion a high resistivity fluid for increasing the electrical resistivity of said lean portion;

establishing a series electric circuit comprising:

a source of alternating current power, a first subterranean electrode electrically connected to one terminal of said source and located in said formation in or in proximity to a first well in said formation, a second subterranean electrode electrically connected to the other terminal of said source and located in said formation in or in proximity to a second well in said formation, and said rich portion located between said electrodes;

injecting a low resistivity liquid through an injection well into a region of said formation that forms a part of said circuit in series with said first electrode and said rich portion; and passing alternating current from said power source through said circuit so as to cause selective electrical resistance heating of said rich portion, whereby the resistance to the flow of oil contained in said rich portion is reduced so that drainage of oil from said rich portion to a recovery well is promoted.

23. A method as set forth in claim 22 wherein said high resistivity fluid is substantially fresh water.

24. A method as set forth in claim 22 wherein said rich portion is located in the up-dip region of a dipping reservoir, connate water is located in the down-dip region thereof, a production well penetrates the oil/water interface, fresh water is injected at the production well into the water phase so as to increase the resistivity thereof, and current is thereafter applied in said circuit so as to selectively heat the oil layer and promote drainage toward the production well.

25. A method as set forth in claim 22, 23 or 24 wherein said low resistivity liquid is injected during electrical resistance heating so that convective heating arising from penetration of heated low resistivity liquid into said portion contributes to the heating of the oil therein for reducing its viscosity and promoting recovery.

26. A method as set forth in claim 1, 2, 3, 12, 20 or 22 wherein the recovery of oil from the selectively heated portion is promoted by the displacement of oil by gas evolved as a consequence of heating.

27. A method as set forth in claim 1, 2, 3, 12, 20 or 22 wherein selectivity of heating is enhanced by injection of a resistive fluid in a marginal zone between the portion to be heated and an adjoining region which would otherwise have sufficient conductivity to divert part of the current.

28. A method as set forth in claim 27 wherein high resistivity liquid is injected near the base of an oil zone that is to be selectively heated.

29. A method as set forth in claim 27 wherein a resistive fluid is injected near the top of an oil zone that is to be heated.

30. A method as set forth in claim 27 wherein a gas phase is generated at the top of an oil zone by allowing reservoir pressure to decline until the pressure of the oil at the top of the zone is below its bubble point.

31. A method as set forth in claim 1, 2, 3, 12, 20 or 22 wherein said low resistivity liquid is injected prior to application of current so that resistance heating power consumption is minimized in the vicinity of said first electrode and correspondingly maximized in said portion, whereby electrical energy is conserved while effecting selective electrical resistance heating.

* * * * *